US007026993B2

(12) United States Patent
Zhang et al.

(10) Patent No.: US 7,026,993 B2
(45) Date of Patent: Apr. 11, 2006

(54) PLANAR ANTENNA AND ARRAY ANTENNA

(75) Inventors: Xin Zhang, Tokyo (JP); Seiji Kado, Tokyo (JP); Hiroaki Satou, Tokyo (JP)

(73) Assignee: Hitachi Cable, Ltd., Tokyo (JP)

( * ) Notice: Subject to any disclaimer, the term of this patent is extended or adjusted under 35 U.S.C. 154(b) by 162 days.

(21) Appl. No.: 10/446,001

(22) Filed: May 27, 2003

(65) Prior Publication Data

US 2004/0027291 A1 Feb. 12, 2004

(30) Foreign Application Priority Data

May 24, 2002 (JP) ..... 2002-151099
May 24, 2002 (JP) ..... 2002-151100
May 24, 2002 (JP) ..... 2002-151101

(51) Int. Cl.
*H01Q 1/38* (2006.01)

(52) U.S. Cl. ..... 343/700 MS; 343/846

(58) Field of Classification Search ..... 343/700 MS, 343/846, 484, 872
See application file for complete search history.

(56) References Cited

U.S. PATENT DOCUMENTS 4,125,837 A * 11/1978 Kaloi ..... 343/700 MS
4,816,835 A * 3/1989 Abiko et al. ..... 343/700 MS
5,181,042 A * 1/1993 Kaise et al. ..... 343/700 MS
5,376,942 A * 12/1994 Shiga ..... 343/700 MS
5,510,803 A * 4/1996 Ishizaka et al. ..... 343/700 MS
5,554,995 A * 9/1996 Jun ..... 343/700 MS
6,133,880 A * 10/2000 Grangeat et al. .... 343/700 MS
6,342,857 B1 * 1/2002 Lane ..... 343/700 MS

FOREIGN PATENT DOCUMENTS

JP 5-152843 6/1993
JP 6-125214 5/1994
JP 10-261917 9/1998
JP 11-136024 5/1999

* cited by examiner

*Primary Examiner*—Tan Ho
(74) *Attorney, Agent, or Firm*—Barnes & Thornburg LLP; James B. Conte

(57) ABSTRACT

A planar antenna has a radiating element that radiates electric wave, and an earthing conductive plate that reflects the electric wave radiated from the radiating element. There is formed a space between the earthing conductive plate and the radiating element. The radiating element has a strip-shaped central conductive part with a length corresponding to the half wavelength of a first transmission radio frequency signal, and strip-shaped conductive parts with a length corresponding to the half wavelength of a second transmission radio frequency signal that has a frequency different from that of the first transmission radio frequency signal.

16 Claims, 18 Drawing Sheets

PLANAR ANTENNA AND ARRAY ANTENNA

The present application is based on Japanese Patent Application numbers 2002-151099, 2002-151100 and 2002-151101, the entire contents of which are incorporated herein by reference.

BACKGROUND OF THE INVENTION

1. Field of the Invention

This invention relates to a planar antenna and particularly to an arrayed planar antenna where a plurality of radiating elements are arrayed on a dielectric plate.

2. Description of the Related Art

Planar antennas used for micro wave, millimetric-wave etc. are composed of an earthing conductive plate, a feeding substrate where a radiating element is formed on a dielectric plate, a band adjusting element plate where a band adjusting conductive element is formed on a dielectric plate, an unnecessary radiation suppressing conductive plate where a slot for suppressing unnecessary radiation is formed on a dielectric plate. The components above are stacked in this order on the earthing conductive plate. The radiating element is of conductive part to radiate a radio wave by resonating at the half wavelength of transmission radio frequency signal.

FIG. 1 is a plan view showing the arrangement of radiating elements of a radiating element plate 1A in a conventional arrayed planar antenna. As shown in FIG. 1, the radiating elements 1 each are arrayed at an equal interval L1 on a dielectric plate 5 of the radiating element plate 1A.

In the conventional planar antennas, the dielectric plate is costly since its quality has to be high in order to reduce the loss thereby enhancing the efficiency. Also, the productivity of the conventional planar antennas is low since it is difficult to accurately position the dielectric plates, radiating elements etc. when they are stacked to fabricate the planar antenna.

On the other hand, it is desired that one planar antenna can be adapted to several frequency bands since radio communications using several frequency bands are recently becoming popular.

Furthermore, although in the conventional planar antennas a plurality of radiating elements are, as shown in FIG. 1, arrayed connected in parallel by a feeder wiring to enhance the output of the antenna, there are problems that the radiating elements influence one another or the feeder wiring influences the radiating element, thereby causing an unnecessary radiation, a reduction in directivity etc.

SUMMARY OF THE INVENTION

It is an object of the invention to provide a planar antenna that offers a good efficiency even when it is manufactured using common and inexpensive materials, It is another object of the invention to provide a planar antenna that offers a good productivity.

It is a further object of the invention to provide a planar antenna that can efficiently adapt to multiple frequency bands.

According to one aspect of the invention, a planar antenna comprises a radiating element that radiates electric wave and an earthing conductive plate that reflects the electric wave radiated from the radiating element, wherein: the radiating element is formed on one surface of a first dielectric plate, the other surface of which facing the earthing conductive plate; and there is formed a space between the earthing conductive plate and the radiating element.

According to another aspect of the invention, a planar antenna comprises a radiating element that radiates electric wave, the radiating element being of a conductive plate, wherein: the radiating element is composed of a strip-shaped central conductive part with a length corresponding to the half wavelength of a first transmission radio frequency signal, and strip-shaped conductive parts with a length corresponding to the half wavelength of a second transmission radio frequency signal that has a frequency different from that of the first transmission radio frequency signal, the central conductive part and the conductive parts being formed into one body such that the conductive parts are located self-symmetrical to the central conductive part.

According to a further aspect of the invention, a planar antenna, comprises a plurality of radiating elements that are arrayed like a matrix on one surface of a dielectric plate, wherein: the plurality of radiating elements are divided into a plurality of groups, and the interval between the respective groups is different from the interval between the respective radiating elements.

BRIEF DESCRIPTION OF THE DRAWINGS

Preferred embodiments of the invention will he described with reference to the accompanying drawings, wherein.

DETAILED DESCRIPTION OF THE PREFERRED EMBODIMENTS

Figure 1:
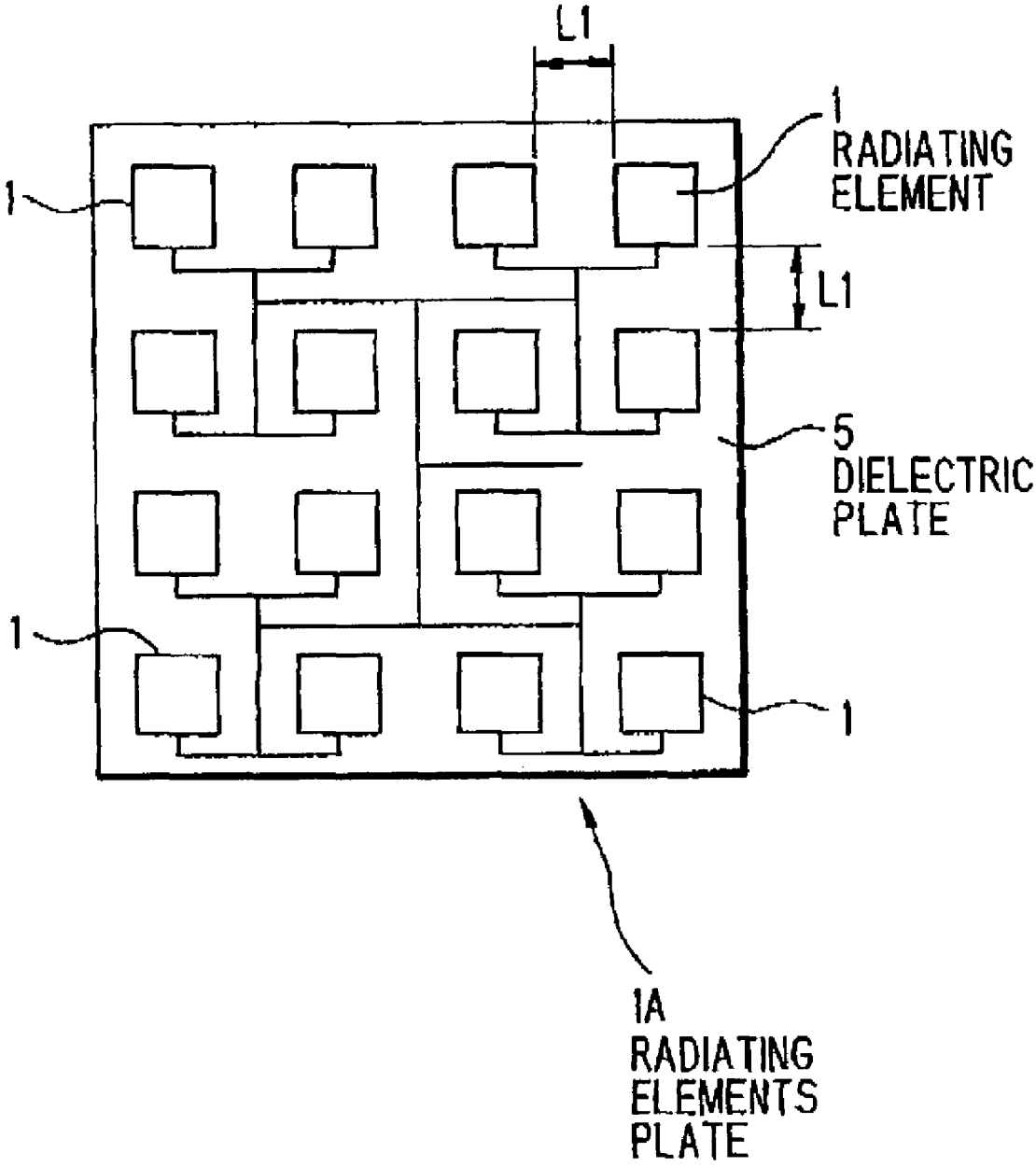
FIG. 1 PRIOR ART
FIG. 1 is a plan view showing the radiating elements arranged in the radiating element plate 1A composing the conventional arrayed planar antenna.
Figure 2:
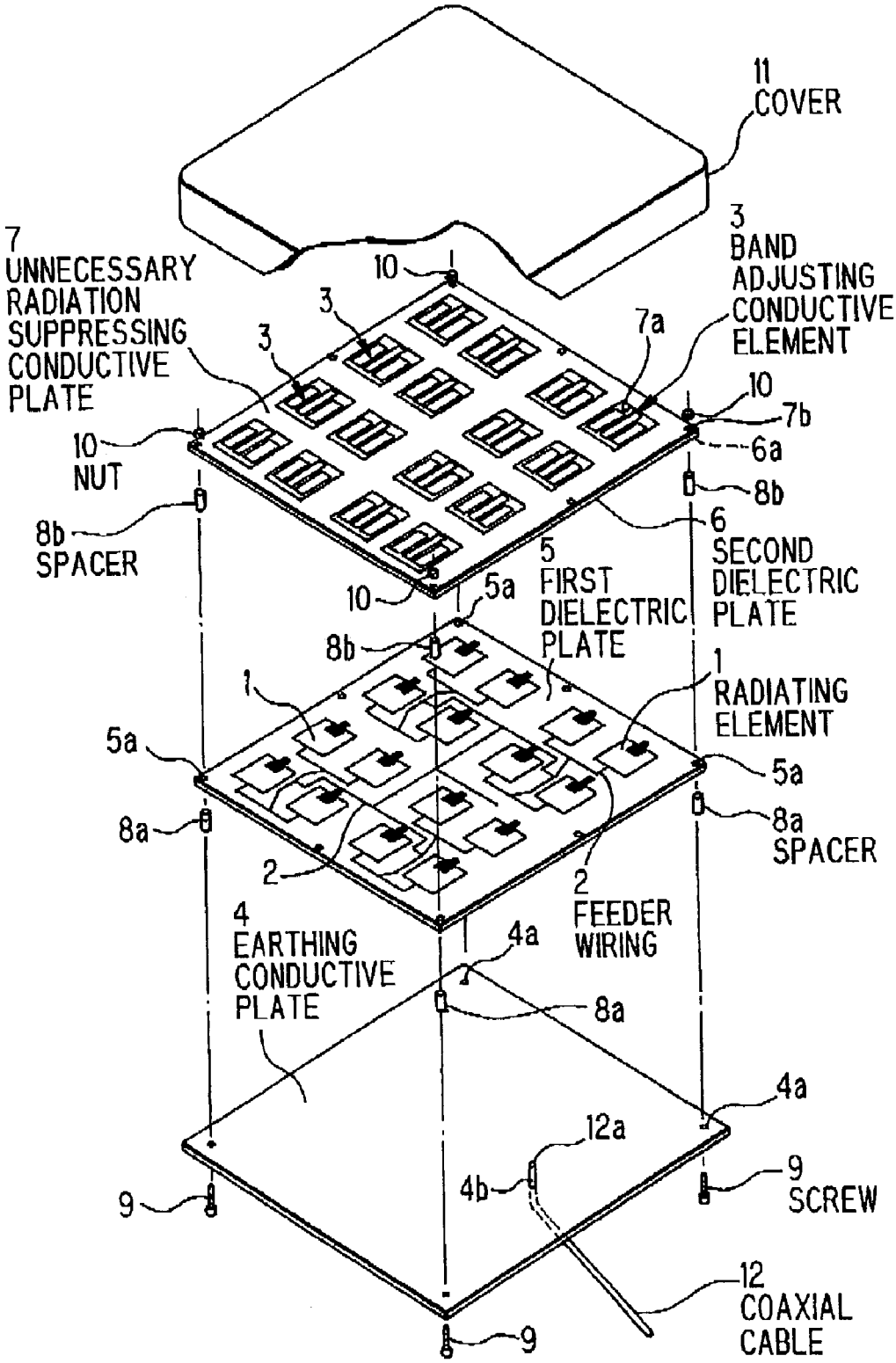
FIG. 2 is a broken perspective view showing a planar antenna in a preferred embodiment according to the invention.

FIG. 2 shows the planar antenna in the preferred embodiment according to the invention. As shown in FIG. 2, the planar antenna is composed of; an earthing conductive plate 4; a first dielectric plate 5 on which a plurality of radiating elements 1, whose number is sixteen in FIG. 2 but not limited by this number, are formed connected in parallel by a feeder wiring 2; a second dielectric plate 6 on which a unnecessary radiation suppressing conductive plate 7 having a plurality of slots 7*a*, whose number is sixteen in FIG. 2 but not limited by this number and can be the same number as the radiating elements 1, and a plurality of band adjusting conductive elements 3 in the respective slots 7*a* are formed; and a cover 11 which covers the surface of the planar antenna. The earthing conductive plate 4, first dielectric plate S, and second dielectric plate 6 are fixed through screws 9 and nuts 10 to connect to each other and spacers 8*a*, 8*b* to be located between the respective two plates to make a space therebetween. Therefore, spaces are formed between the earthing conductive plate 4 and the dielectric plate 5, and between the first dielectric plate 5 and the second dielectric plate 6. The fixing member is not limited to the screw 9 and nut 10, but may be, e.g., a split pin or adhesive.

The earthing conductive plate 4 is, for example, a silver-plated copper plate or a rustproof copper plate and has through holes 4*a*, through which the screw 9 can penetrate, at the corner of the plate 4. In FIG. 2, the four through holes 4*a*, screws 9 and nuts 10 respectively are shown but its number is not limited by the number.

The feeder wiring 2 and radiating elements 1 are patterned by printed wiring technique on the surface of the first dielectric plate 5 of, e.g., Teflon (R). Namely, the feeder wiring 2 and radiating elements 1 are fabricated by etching a single-sided printed wiring board. Through holes 5*a*, through which the screw 9 can penetrate, are formed at the corner of the first dielectric plate 5.

The band adjusting conductive elements 3 and slots 7*a* are patterned by printed wiring technique on the surface of the second dielectric plate 6 of, e.g., Teflon®. Namely, the band adjusting conductive elements 3 and slots 7*a* are fabricated by etching a single-sided printed wiring board. Through holes 6*a* and 7*b*, through which the screw 9 can penetrate, are formed at the corner of the second dielectric plate 6 and unnecessary radiation suppressing conductive plate 7, respectively.

The planar antenna is assembled by penetrating the screws 9 through the through holes 4*a*, 5*a*, 6*a* and 7*b* at the corners of the earthing conductive plate 4, first dielectric plate 5 and second dielectric plate 6 with unnecessary radiation suppressing conductive plate 7, respectively while locating the spacers 8*a* and 8*b* between the respective two plates, connecting them with the nuts 10, then covering them with the cover 11 of, e.g., Teflon ®. The cover 11 which covers all the side walls of the earthing conductive plate 4 functions to prevent rain or water from invading the inside of the planar antenna.

Electric power is supplied from outside to the feeder wiring 2 by connecting the inner conductor 12*a* of a coaxial cable 12, which penetrates through the earthing conductive plate 4, to the feeder wiring 2.

The spaces formed between the earthing conductive plate 4 and the first single-sided printed wiring board, i.e., the radiating elements 1, and between the first single-sided printed wiring board and the second single-sided printed wiring board, i.e., unnecessary radiation suppressing conductive plate 7 with the band adjusting conductive elements 3, respectively are free spaces. Therefore, they function to be a dielectric having a permittivity of 1 and a small loss. The spaces function as a dielectric that is located between the earthing conductive plate 4 and the radiating elements 1, and between the radiating element 1 and the unnecessary radiation suppressing conductive plate 7 with the band adjusting conductive elements 3, respectively, together with the dielectrics composing the first single-sided printed wiring board and second single-sided printed wiring board.

Of the permittivity between the earthing conductive plate 4 and radiating element 1, and between the radiating element 1 and the unnecessary radiation suppressing conductive plate 7 with the band adjusting conductive elements 3, respectively, the permittivity of the spaces being located therebetween becomes dominant. Therefore, even a common and inexpensive printed wiring board that has a higher permittivity than that of the space can be used as the first and second dielectric plates.

The planar antenna thus composed can efficiently adapt to two kinds of frequency bands and suppress the radiation of unnecessary radio wave. Also, it can offer a higher productivity because the radiating elements 1, feeder wiring 2, band adjusting elements 3 and unnecessary radiation suppressing conductive plate 7 can be fabricated by etching the single-sided printed wiring board.

Next, the radiating element 1 will be explained referring to FIG. 3.

Figure 3:
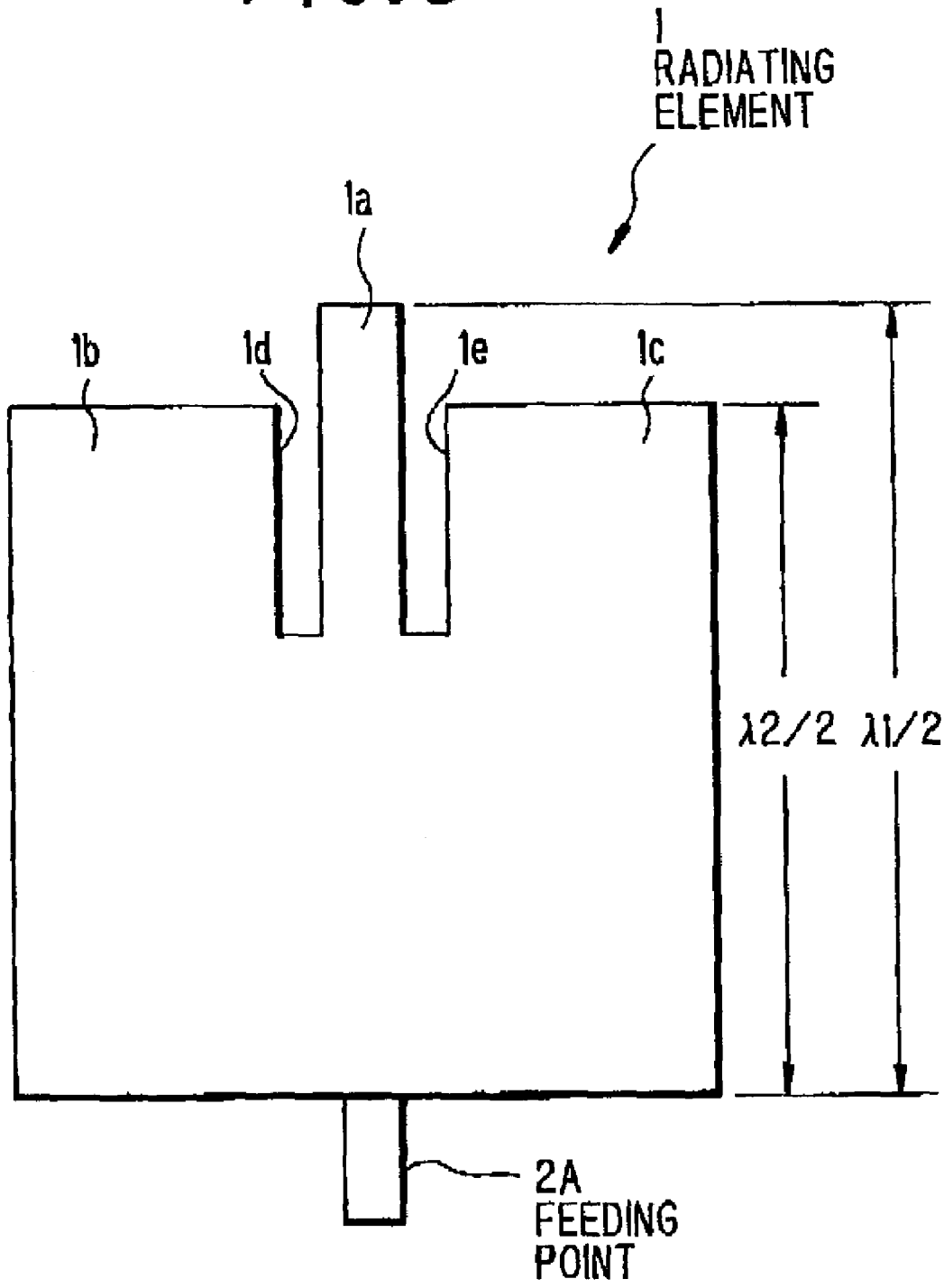
FIG. 3 is a plan view showing a radiating element 1 of the planar antenna in FIG. 2.

FIG. 3 is a plan view of the radiating element 1 shown in FIG. 2.

The explanation below is made under the conditions that the radiating element 1 is of a conductive plate (e.g., a silver-plated copper plate, a gold-plated copper plate) to adapt to two different frequency bands f1 (wavelength $\lambda 1$) and f2 (wavelength $\lambda 2$, where f1<f2).

The radiating element 1 is formed into one body such that, to a strip-shaped central conductive part 1*a* with a length ($\lambda 1/2$) corresponding to the half wavelength of the transmission radio frequency signal f1(frequency f1), two conductive parts 1*b*, 1*c* with a length ($\lambda 2/2$) corresponding to the half wavelength of a transmission radio frequency signal f2(frequency f2), which is different from the signal f1, are self-symmetrical. Between the respective conductive parts 1*a*, 1*b* and 1*c*, there are formed slit-shaped cutting regions 1*d*, 1*e* along the longitudinal direction of the central conductive part 1*a* in order to sufficiently separate the radio frequency signals f1 and f2.

When electric power is supplied from the feeder wiring 2 to the radiating element 1, the central conductive part 1*a* resonates with the lower radio frequency signal f1 and radiates a lower-frequency radio wave in the direction perpendicular to the paper surface, and the conductive parts 1*b*, 1*c* resonate with the higher radio frequency signal f1 and radiates a higher-frequency radio wave.

The planar antenna using the radiating element 1 thus composed can efficiently radiate the two kinds of frequency band radio wave even when it is formed into one body.

Next, the band adjusting conductive elements 3 will be explained referring to FIG. 4.

Figure 4:
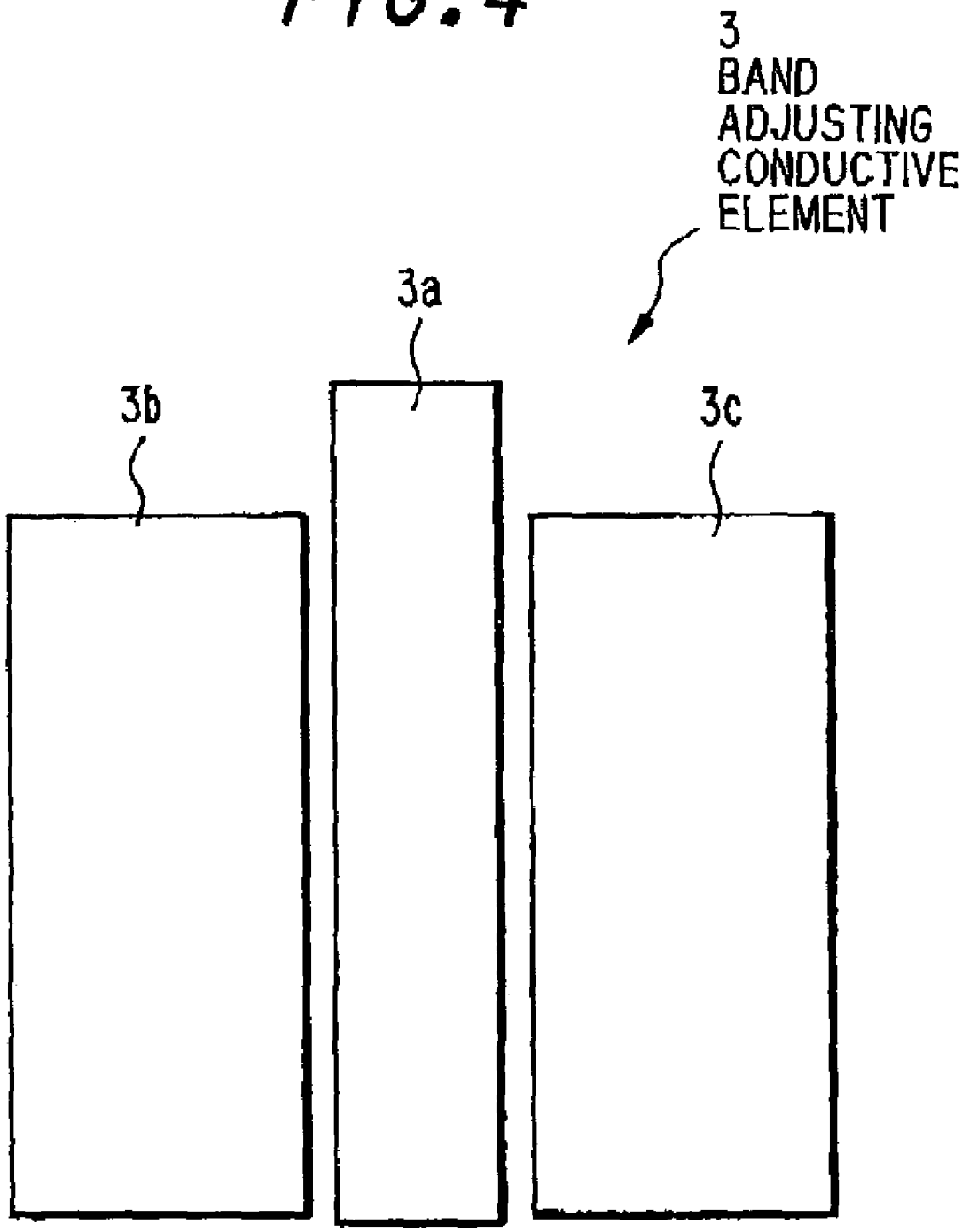
FIG. 4 is a plan view showing a band adjusting element 3 of the planar antenna in FIG. 2.

FIG. 4 is a plan view of the radiating element 1 shown in FIG. 2.

The explanation below is made under the conditions that the band adjusting conductive element 3 is of a conductive plate (e.g., a silver-plated copper plate, gold-plated copper plate) to adapt to two different frequency bands f1, f2.

The band adjusting conductive element 3 is composed of a strip-shaped conductive plate 3*a* with a length corresponding to the half wavelength of transmission radio frequency signal f1, and two strip-shaped conductive plates 3*b*, 3*c*, which are separately located on both sides of the conductive plate 3*a*, with a length corresponding to the half wavelength of transmission radio frequency signal f2.

Therefore, of the band adjusting conductive element 3, the central conductive plate 3*a* functions to intensively influence the lower frequency band signal f1 to enlarge the band width of the frequency band signal f1, and the conductive plates 3*b*, 3*c* functions to intensively influence the higher frequency band signal f2 to enlarge the band width of the frequency band signal f2. Thus, the band adjusting conductive element 3 can contribute to enlarging the available frequency band of the planar antenna.

Figure 5:
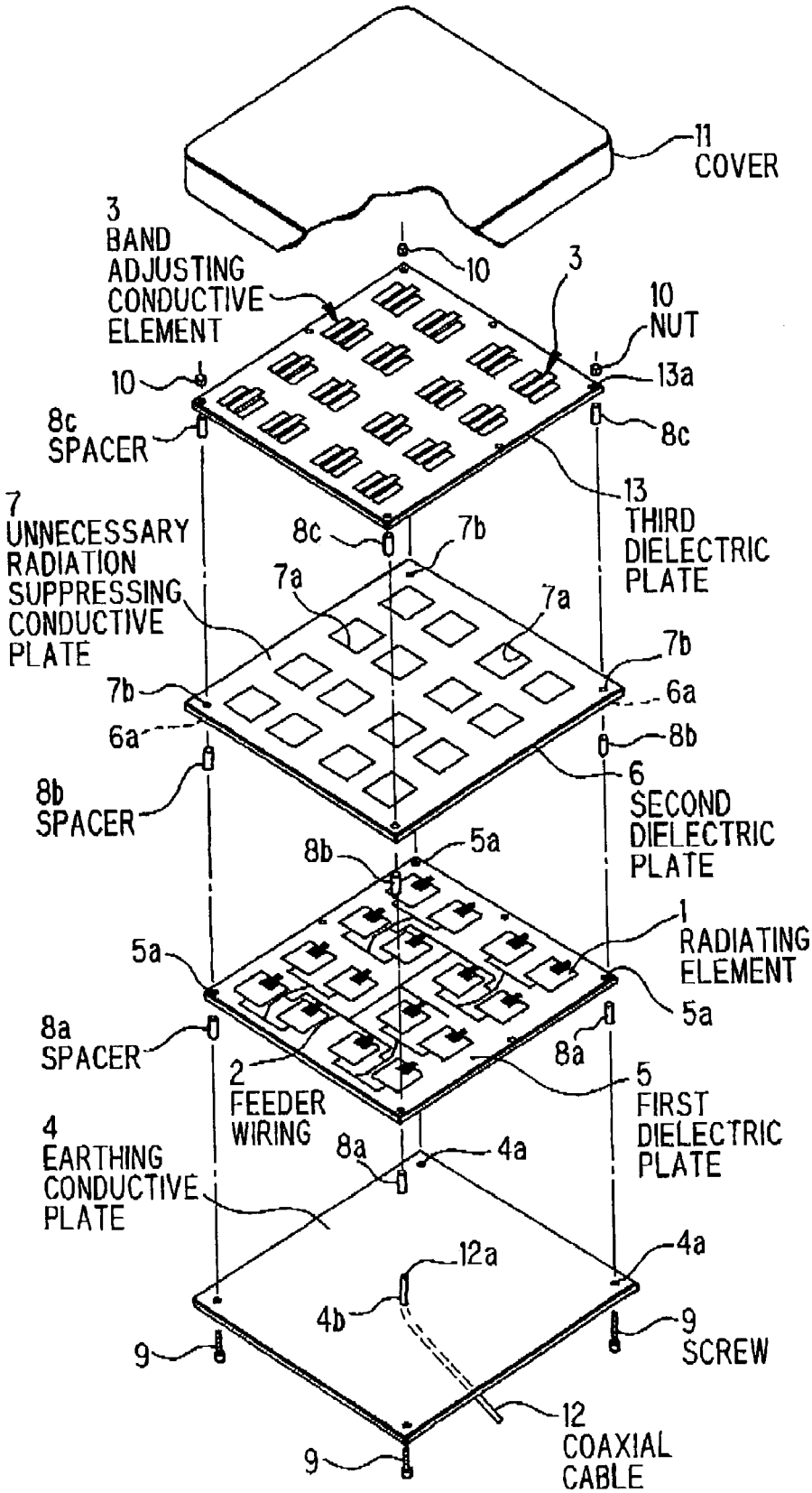
FIG. 5 is a broken perspective view showing a planar antenna in another preferred embodiment according to the invention.

FIG. 5 shows a planar antenna in another preferred embodiment according to the invention.

The planar antenna is composed of: an earthing conductive plate 4; a first dielectric plate 5 on which a plurality of radiating elements 1, whose number is sixteen in FIG. 5 but not limited by this number, are formed connected in parallel by a feeder wiring 2 that is patterned by printed wiring technique on one surface (in FIG. 5, upper surface) of the first dielectric plate 5; a second dielectric plate 6 on which a unnecessary radiation suppressing conductive plate 7 having a plurality of slots 7*a* is formed by printed wiring technique on one surface (in FIG. 5, upper surface) of the second dielectric plate 6; a third dielectric plate 13 on which a plurality of band adjusting conductive elements 3 are formed by printed wiring technique on one surface (in FIG. 5, upper surface) of the third dielectric plate 13 and a cover 11 which covers the surface of the planar antenna. The earthing conductive plate 4. first dielectric plate 5, second dielectric plate 6 and third dielectric plate 13 are fixed through screws 9 and nuts 10 to connect to each other and spacers 8*a*, 8*b* and 8*c* to be located between the respective two plates to make a space therebetween.

The first dielectric plate 5 with the feeder wiring 2 and radiating elements 1 is fabricated by etching a first single-sided printed wiring board. The second dielectric plate 6 with the unnecessary radiation suppressing conductive plate 7 is fabricated by etching a second single-sided printed wiring board. The third dielectric plate 13 with the band adjusting conductive elements 3 is fabricated by etching a third single-sided printed wiring board.

The planar antenna is assembled by penetrating the screws 9 through the through holes 4*a*, 5*a*, 6*a*, 7*b* and 13*a* at the corners of the earthing conductive plate 4, first dielectric plate 5, second dielectric plate 6 with unnecessary radiation suppressing conductive plate 7 and third dielectric plate 13, respectively while locating the spacers 8*a*, 8*b* and 8*c* between the respective two plates, connecting them with the nuts 10, then covering them with the cover 11 of, e.g., Teflon®.

The details of the radiating element 1 and band adjusting conductive elements 3 are the same as those shown in FIGS. 3 and 4, respectively and, therefore, their explanations are omitted here.

Electric power is supplied from outside to the feeder wiring 2 by connecting the inner conductor 12*a* of a coaxial cable 12, which penetrates through the earthing conductive plate 4, to the feeder wiring 2.

In the planar antenna thus composed, of the permittivity between the earthing conductive plate 4 and radiating element 1, and between the radiating element 1 and the unnecessary radiation suppressing conductive plate 7 and the band adjusting conductive elements 3, respectively, the permittivity of the spaces being located therebetween becomes dominant. Therefore, even a common and inexpensive printed wiring board that has a higher permittivity than that of the space can be used as the first to third dielectric plates.

Also, the planar antenna thus composed can efficiently adapt to two kinds of frequency bands and suppress the radiation of unnecessary radio wave. The band adjusting conductive element 3 can contribute to enlarging the available frequency band of the planar antenna Further, it can offer a higher productivity because the radiating elements 1, feeder wiring 2, unnecessary radiation suppressing conductive plate 7 and band adjusting elements 3 can be fabricated by etching the single-sided printed wiring board.

Figure 6:
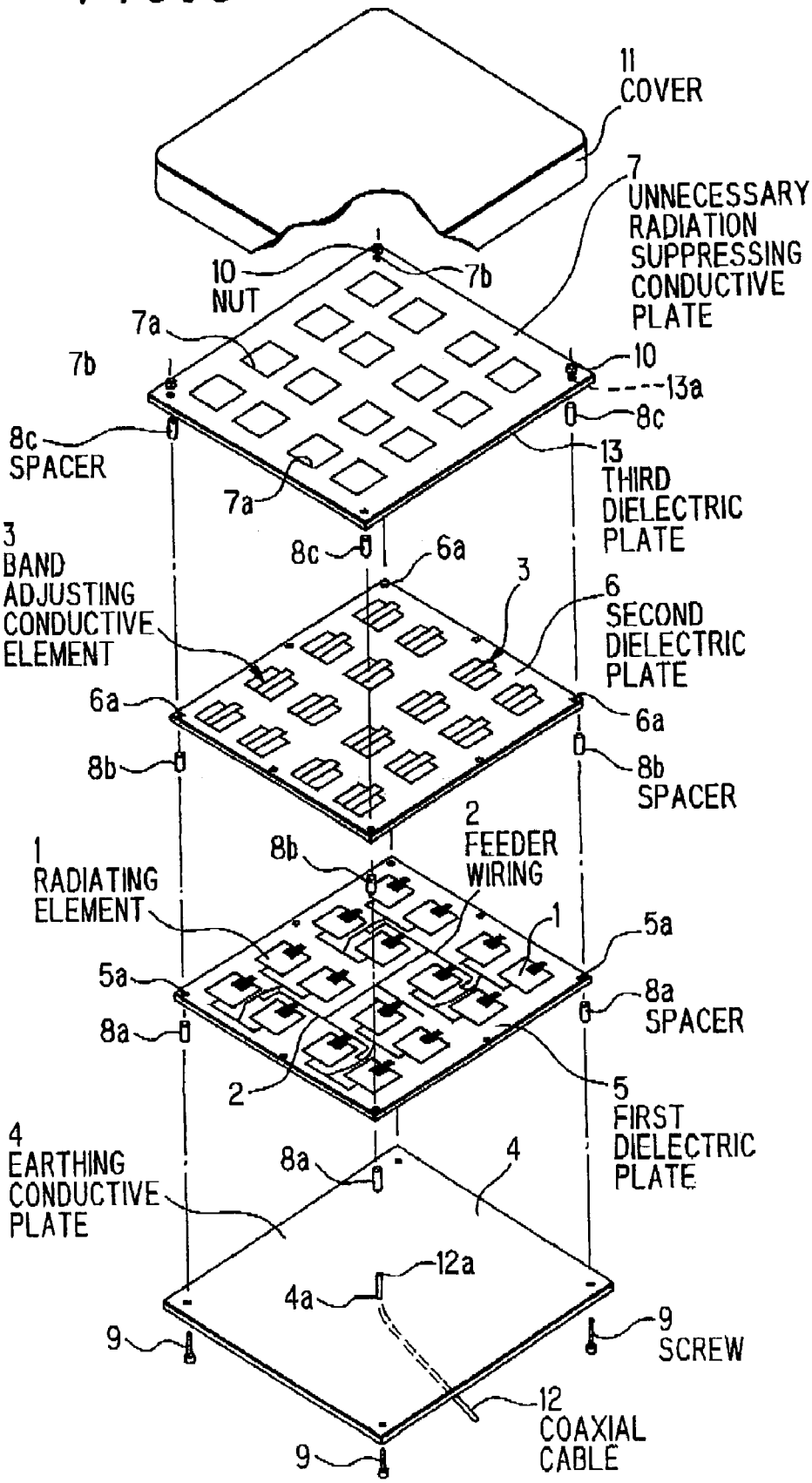
FIG. 6 is a broken perspective view showing a planar antenna in a further preferred embodiment according to the invention.

FIG. 6 shows a planar antenna in the further preferred embodiment according to the invention.

The planar antenna is composed of: an earthing conductive plate 4; a first dielectric plate 5 on which a plurality of radiating elements 1, whose number is sixteen in FIG. 6 but not limited by this number, are formed connected in parallel by a feeder wiring 2 that is patterned by printed wiring technique on one surface (in FIG. 6, upper surface) of the first dielectric plate 5; a third dielectric plate 6 on which a plurality of band adjusting conductive elements 3 are formed by printed wiring technique on one surface (in FIG. 5, upper surface) of the second dielectric plate 6; a third dielectric plate 13 on which a unnecessary radiation suppressing conductive plate 7 having a plurality of slots 7*a* is formed by printed wiring technique on one surface (in FIG. 6, upper surface) of the third dielectric plate 13 and a cover 11 which covers the surface of the planar antenna. The earthing conductive plate 4, first dielectric plate 5, second dielectric plate 6 and third dielectric plate 13 are fixed through screws 9 and nuts 10 to connect to each other and spacers 8*a*, 8*b* and 8*c* to be located between the respective two plates to make a space therebetween.

The first dielectric plate 5 with the feeder wiring 2 and radiating elements 1 is fabricated by etching a first single-sided printed wiring board. The second dielectric plate 6 with the band adjusting conductive elements 3 is fabricated by etching a second single-sided printed wiring board. The third dielectric plate 13 with the unnecessary radiation suppressing conductive plate 7 is fabricated by etching a third single-sided printed wiring board.

The planar antenna is assembled by penetrating the screws 9 through the through holes 4*a*, 5*a*, 6*a*, 7*b* and 13*a* at the corners of the earthing conductive plate 4, first dielectric plate 5, second dielectric plate 6 and third dielectric plate 13 with unnecessary radiation suppressing conductive plate 7, respectively while locating the spacers 8*a*,

8*b* and 8*c* between the respective two plates, connecting them with the nuts 10, then covering them with the cover 11 of, e.g., Teflon®.

The details of the radiating element 1 and band adjusting conductive elements 3 are the same as those shown in FIGS. 3 and 4 respectively and, therefore, their explanations are omitted here.

Electric power is supplied from outside to the feeder wiring 2 by connecting the inner conductor 12*a* of a coaxial cable 12, which penetrates through the earthing conductive plate 4, to the feeder wiring 2.

In the planar antenna thus composed, of the permittivity between the earthing conductive plate 4 and radiating element 1, and between the radiating element 1 and the band adjusting conductive elements 3 and the unnecessary radiation suppressing conductive plate 7, respectively, the permittivity of the spaces being located therebetween becomes dominant. Therefore, even a common and inexpensive printed wiring board that has a higher permittivity than that of the space can be used an the first to third dielectric plates.

Also, the planar antenna thus composed can efficiently adapt to two kinds of frequency bands and suppress the radiation of unnecessary radio wave. The band adjusting conductive element 3 can contribute to enlarging the available frequency band of the planar antenna. Further, it can offer a higher productivity because the radiating elements 1, feeder wiring 2, band adjusting elements 3 and unnecessary radiation suppressing conductive plate 7 can be fabricated by etching the single-sided printed wiring board.

FIGS. 7A to 7D are plan views showing radiating elements 1-1 to 1-4 available for a planar antenna in the further preferred embodiment according to the invention.

Figure 7A:
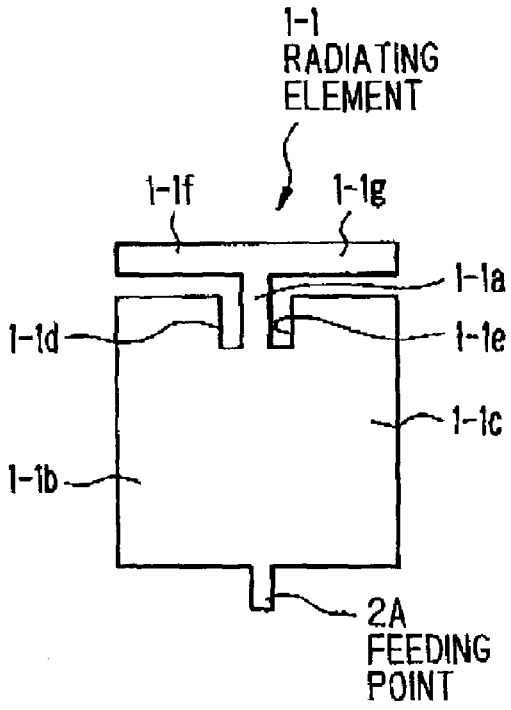
FIGS. 7A to 7D are plan views showing radiating elements 1-1 to 1-4 available for a planar antenna in a further preferred embodiment according to the invention.

As shown in FIG. 7A, the radiating element 1-1 is formed into one body such that, to a strip-shaped central conductive part 1-1*a* with a length corresponding to the half wavelength of a transmission radio frequency signal f1 (frequency f1), two conductive parts 1-1*b*, 1-1*c* with a length corresponding to the half wavelength of a transmission radio frequency signal f2(frequency f2), which is different from the signal f1, are self-symmetrical. Furthermore, on the opposite side of feeding point 2A of the central conductive part 1-1*a*, two conductive parts 1-*f*, 1-*g* with a length corresponding to the half wavelength of a transmission radio frequency signal f3 (frequency f3, where f2<f3), which is different from the transmission radio frequency signals f1, f2, are vertical to the central conductive part 1-1*a*. Between the respective conductive parts 1-1*a*, 1-1*b* and 1-1*c*, there are formed slit-shaped cutting regions 1-1*d*, 1-1*e* along the longitudinal direction of the central conductive part 1-1*a* in order to sufficiently separate the radio frequency signals f1 and f2.

The planar antenna using the radiating element 1-1 thus composed can efficiently radiate the three kinds of frequency band radio wave even when it is formed into one body.

Figure 7B:
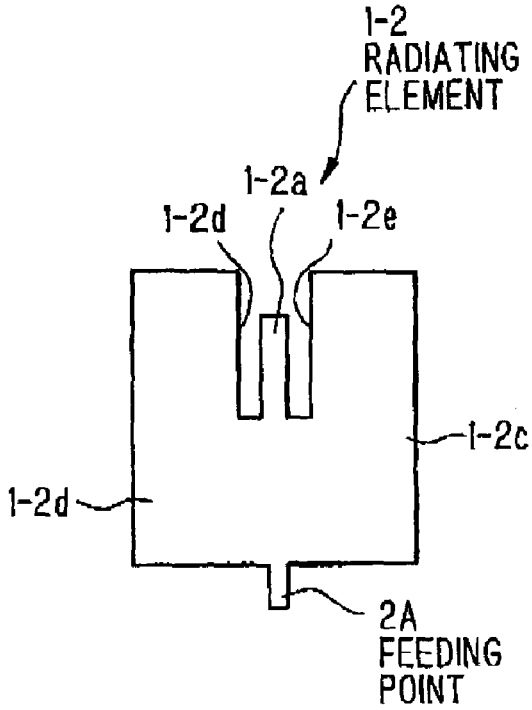

As shown in FIG. 7B, the radiating element 1-2 is formed into one body such that, to a strip-shaped central conductive part 1-2*a* with a length corresponding to the half wavelength of the transmission radio frequency signal f2(frequency f2), two conductive parts l-2*b*, 1-2*c* with a length corresponding to the half wavelength of a transmission radio frequency signal f1(frequency f1), which is different from the signal f2(frequency f2), are self-symmetrical. The central conductive part 1-2*a* is adapted to the higher frequency band f2, and the two conductive parts 1-2*b*, 1-2*c* are adapted to the lower frequency band f1. Thus, the radiating element 1-2 is shaped such that, in the radiating element 1 in FIG. 3, the central conductive part 1*a* is substituted for the conductive part 1*b* or 1*c*.

The planar antenna using the radiating element 1-2 thus composed can enhance a gain for the lower frequency f1.

Figure 7C:
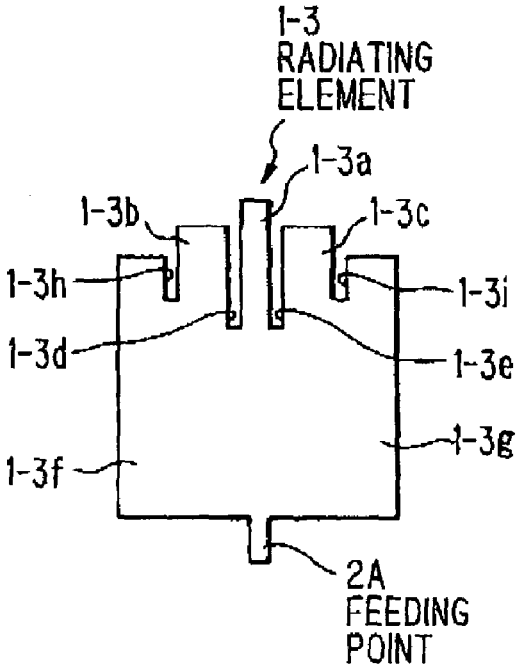

As shown in FIG. 7C, the radiating element 1-3 is formed into one body such that, to a strip-shaped central conductive part 1-3*a* with a length corresponding to the half wavelength of the transmission radio frequency signal f1(frequency f1), two conductive parts 1-3*b*, 1-3*c* with a length corresponding to the half wavelength of a transmission radio frequency signal f2(frequency f2), which is different from the signal f1, are self-symmetrical. Furthermore, on the outside of the conductive parts 1-3*b* and 1-3*c*, two conductive parts 1-3*f*, 1-3*g* with a length corresponding to the half wavelength of a transmission radio frequency signal f3 (frequency f3, where f2<f3), which is different from the signals f1, f2, are self-symmetrical. Between the respective conductive parts 13*a*, 1-3*b*, 1-3*c*, 1-3*f* and 1-3*g*, there are formed slit-shaped cutting regions 1-3*d*, 1-3*e*, 1-3*h* and 1-3*i* in order to sufficiently separate the radio frequency signals f1, f2 and f3.

Figure 7D:
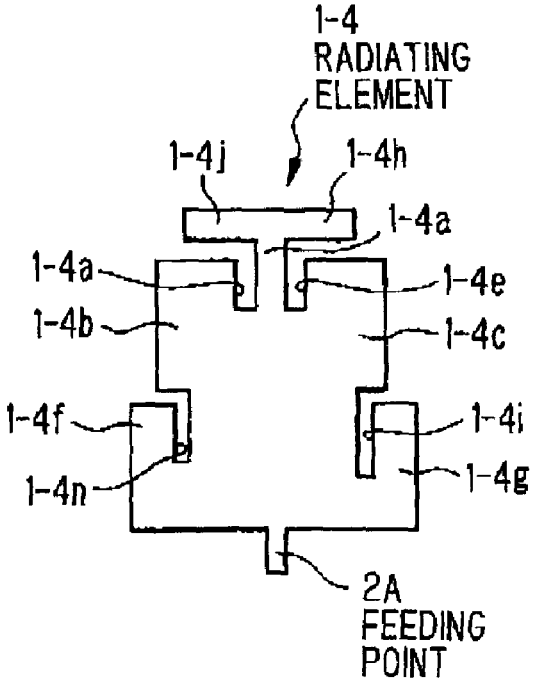

The planar antenna using the radiating element 1-3 thus composed can efficiently radiate the three kinds of frequency band radio wave even when it is formed into one body, As shown in FIG. 7D, the radiating element 14 is formed into one body such that, to a strip-shaped central conductive part 14*a* with a length corresponding to the half wavelength of the transmission radio frequency signal f1(frequency f1), two conductive parts 14*b*, 14*c* with a length corresponding to the half wavelength of a transmission radio frequency signal f2(frequency f2), which is different from the signal f1, are self-symmetrical. Also, on the outside of the conductive parts 14*b* and 14*c*, two conductive parts 14*f*, 14*g* with a length corresponding to the half wavelength of a transmission radio frequency signal f3(frequency f3, where f2<f3), which is different from the signals f1, f2, are self-symmetrical. Furthermore, on the opposite side of feeding point 2A of the central conductive part 14*a*, two conductive parts 14*j*, 14*k* with a length corresponding to the half wavelength of a transmission radio frequency signal f4 (frequency f4, where f3<f4), which is different from the transmission radio frequency signals f1, f2 and f3, are vertical to the central conductive part 14*a*.

Between the respective conductive parts 14*a*, 14*b*, 14*c*, 14*f* and 14*g*, there are formed slit-shaped cutting regions 14*d*, 14*e*, 14*h* and 14*i* in order to sufficiently separate the radio frequency signals f1, f2 and f3.

The planar antenna using the radiating element 14 thus composed can efficiently radiate the four kinds of frequency band radio wave even when it is formed into one body.

FIGS. 8A to 8D are plan views showing band adjusting conductive elements 3-1 to 3-4 available for a planar antenna in the further preferred embodiment according to the invention.

Figure 8A:
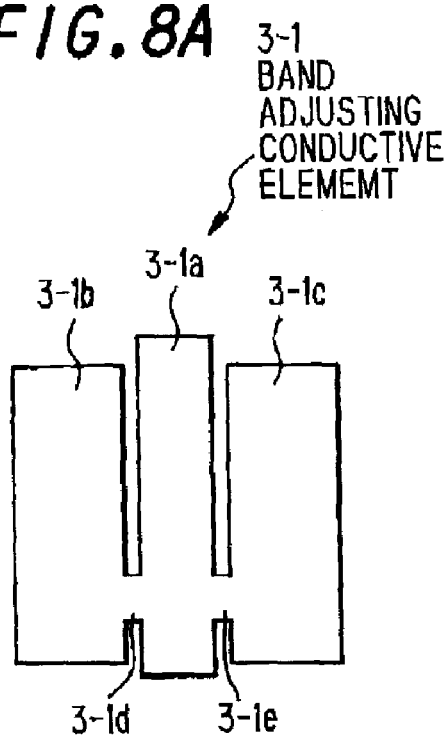
FIGS. 8A to 8D are plan views showing band adjusting conductive elements 3-1 to 3-4 available for a planar antenna in a further preferred embodiment according to the invention.

As shown in FIG. 8A, the band adjusting conductive element 31 is formed such that, to a strip-shaped conductive part 31*a* with a length (λ1/2) corresponding to the half wavelength of a transmission radio frequency signal f1(frequency f1), two conductive parts 31*b*, 31*c* with a length (λ2/2) corresponding to the half wavelength of a transmission radio frequency signal f2(frequency f2), which is different from the signal f1, are self-symmetrical. The respective conductive parts 31*a*, 31*b*, and 31*c* are electrically connected through conductive parts 31*d* and 31*e*.

Thus, the band adjusting conductive element 31 can contribute to enlarging the available frequency band of the planar antenna.

Figure 8B:
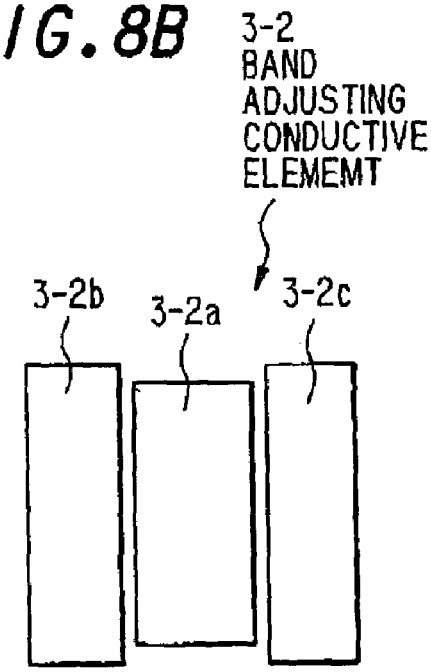

As shown in FIG. 8B, the band adjusting conductive element 32 is composed of a strip-shaped conductive plate 32*a* with a length corresponding to the half wavelength of a transmission radio frequency signal f2 (frequency f2), and two strip-shaped conductive plates 32*b*, 32*c* with a length corresponding to the half wavelength of a transmission radio frequency signal f1(frequency f1), which is different from the signal f2, that are separately located on both sides of the conductive plate 32*a* to be symmetrical to each other.

Thus, the band adjusting conductive element 32 can contribute to enlarging the available frequency band of the planar antenna when it is adapted to the radiating element 1-2 in FIG. 7B.

Figure 8C:
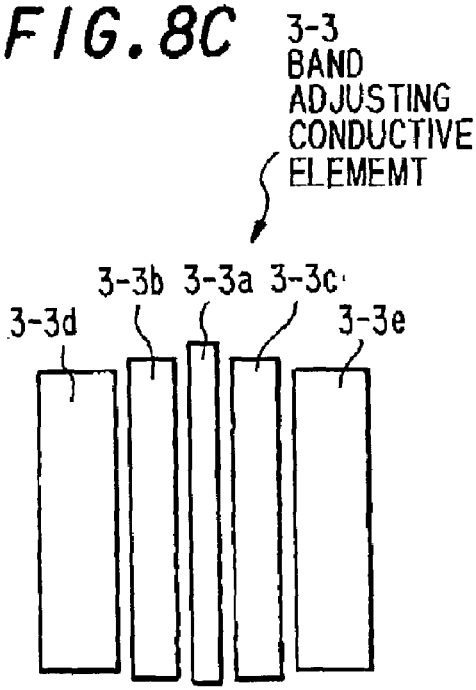

As shown in FIG. 8C, the band adjusting conductive element 3-3 is composed of a strip-shaped conductive plate 3-3*a* with a length corresponding to the half wavelength of a transmission radio frequency signal f1(frequency f1), two strip-shaped conductive plates 3-3*b*, 3-3*c* with a length corresponding to the half wavelength of a transmission radio frequency signal f2 (frequency f2) that are separately located on both sides of the conductive plate 3-3*a* to be symmetrical to each other, and two strip-shaped conductive plates 3-3*d*, 3-3*e* with a length corresponding to the half wavelength of a transmission radio frequency signal f3(frequency f3) that are separately located on the outside of the conductive plates 3-3*b*, 3-3*c* to be symmetrical to each other.

Thus, the band adjusting conductive element 3-3 can contribute to enlarging the available frequency band, frequencies f1 to f3, of the planar antenna when it is adapted to the radiating element 1-3 in FIG. 7C.

Figure 8D:
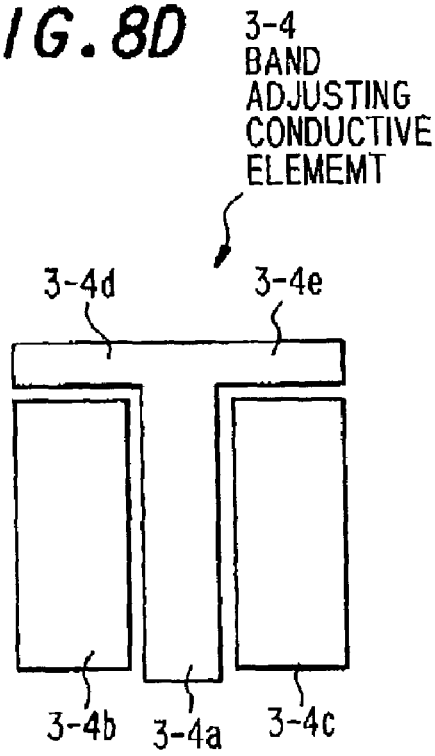

As shown in FIG. 8D, the band adjusting conductive element 3-4 is composed of a strip-shaped conductive plate 3-4*a* with a length corresponding to the half wavelength of a transmission radio frequency signal f1(frequency f1), two strip-shaped conductive plates 3-4*b*, 3-4*c* with a length corresponding to the half wavelength of a transmission radio frequency signal f2 (frequency f2) that are separately located on both sides of the conductive plate 3-4*a* to be symmetrical to each other, and two strip-shaped conductive plates 3-4*d*, 3-4*e* with a length corresponding to the half wavelength of a transmission radio frequency signal f3(frequency f3) that are formed connecting with one end of the conductive plate 3-4*a* to be vertical to the conductive plate 3-4*a*.

Thus, the band adjusting conductive element 3-4 can contribute to enlarging the available frequency band, frequencies f1 to f3, of the planar antenna when it is adapted to the radiating element 1-1 in FIG. 7A.

Figure 9:
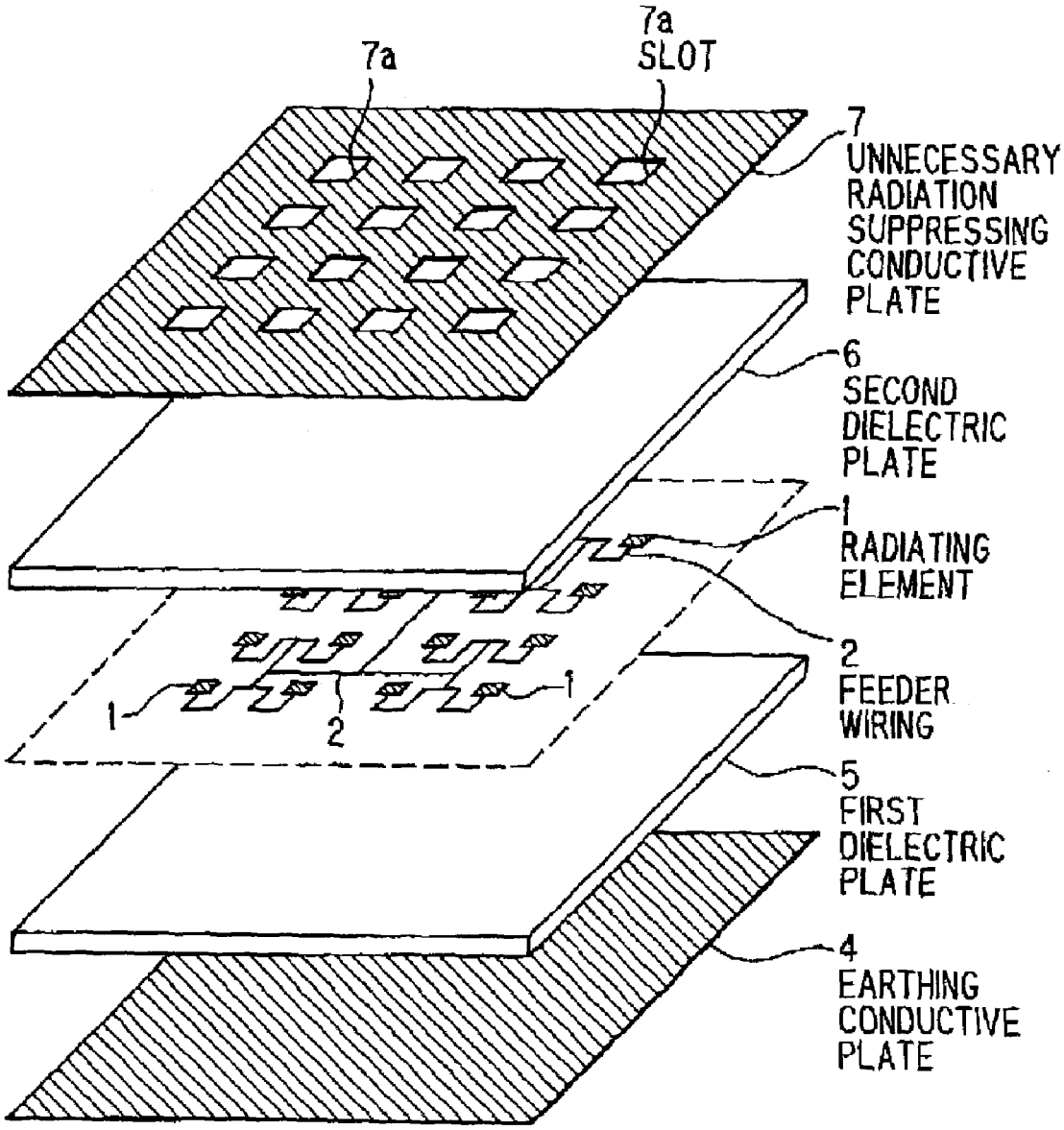
FIG. 9 is a broken perspective view showing a planar antenna in a further preferred embodiment according-to the invention.

FIG. 9 in a broken perspective view showing the planar antenna in the further preferred embodiment according to the invention.

The planar antenna is composed of: an earthing conductive plate 4 (e.g., gold-plated copper plate, silver-plated copper plate); a first dielectric plate 5 of, e.g., Teflon®; a plurality of radiating elements 1, whose number is sixteen in FIG. 9 but not limited by this number, that are connected in parallel by a feeder wiring 2; a second dielectric plate 6 of the same material as the first dielectric plate 5; and an unnecessary radiation suppressing conductive plate 7, the earthing conductive plate 4 to the unnecessary radiation suppressing conductive plate 7 being stacked in this order. The respective slots 7*a* of the unnecessary radiation suppressing conductive plate 7 are located corresponding to the respective radiating elements 1.

The earthing conductive plate 4, first dielectric plate 5, radiating elements 1 and feeder wiring 2 are fabricated using a double-sided printed wiring board (first substrate). The second dielectric plate 6 and unnecessary radiation suppressing conductive plate 7 are fabricated using a single-sided printed wiring board (second substrate)

The first substrate is fabricated such that, of the double-sided wiring board that is made by attaching copper foils onto both surfaces of the first dielectric plate 5 of, e.g., Teflon®, one surface toil (in FIG. 9, lower surface) itself is used as the earthing conductive plate 4, the other surface foil (in FIG. 9, upper surface) is patterned to form the radiating elements 1 and feeder wiring 2.

The second substrate is fabricated such that the single-sided wiring board is made by attaching a copper foil (=unnecessary radiation suppressing conductive plate 7) onto one surface of the second dielectric plate 6, then the copper foil 7 is patterned to have the slots 7*a*.

The planar antenna is assembled by stacking the first substrate and the second substrate while sandwiching a bonding sheet (not shown) therebetween, melting the bonding sheet by heating, then jointing together the two substrates by adhesion.

The planar antenna thus composed can efficiently adapt to two kinds of frequency bands and suppress the radiation of unnecessary radio wave.

Since the first and second substrates are obtained by etching a printed wiring board and are jointed together by adhesion, the planar antenna thus composed has a higher productivity.

The planar antenna shown in FIG. 9 is also assembled by another way <1>described below.

A first substrate composed of the earthing conductive plate 4 and the first dielectric plate 5 is fabricated using a single-sided printed wiring board, and a second substrate composed of the radiating elements 1, the feeder wiring 2, the second dielectric plate 6 and the unnecessary radiation suppressing conductive plate 7 is fabricated using a double-sided printed wiring board. Then, the planar antenna is assembled by stacking the first substrate and the second substrate while sandwiching a bonding sheet therebetween, melting the bonding sheet by heating, then jointing together the two substrates by adhesion.

The planar antenna thus composed can efficiently adapt to two kinds of frequency bands and suppress the radiation of unnecessary radio wave.

Since the first and second substrates are obtained by etching a printed wiring board and are jointed together by adhesion, the planar antenna thus composed has a higher productivity.

Figure 10:
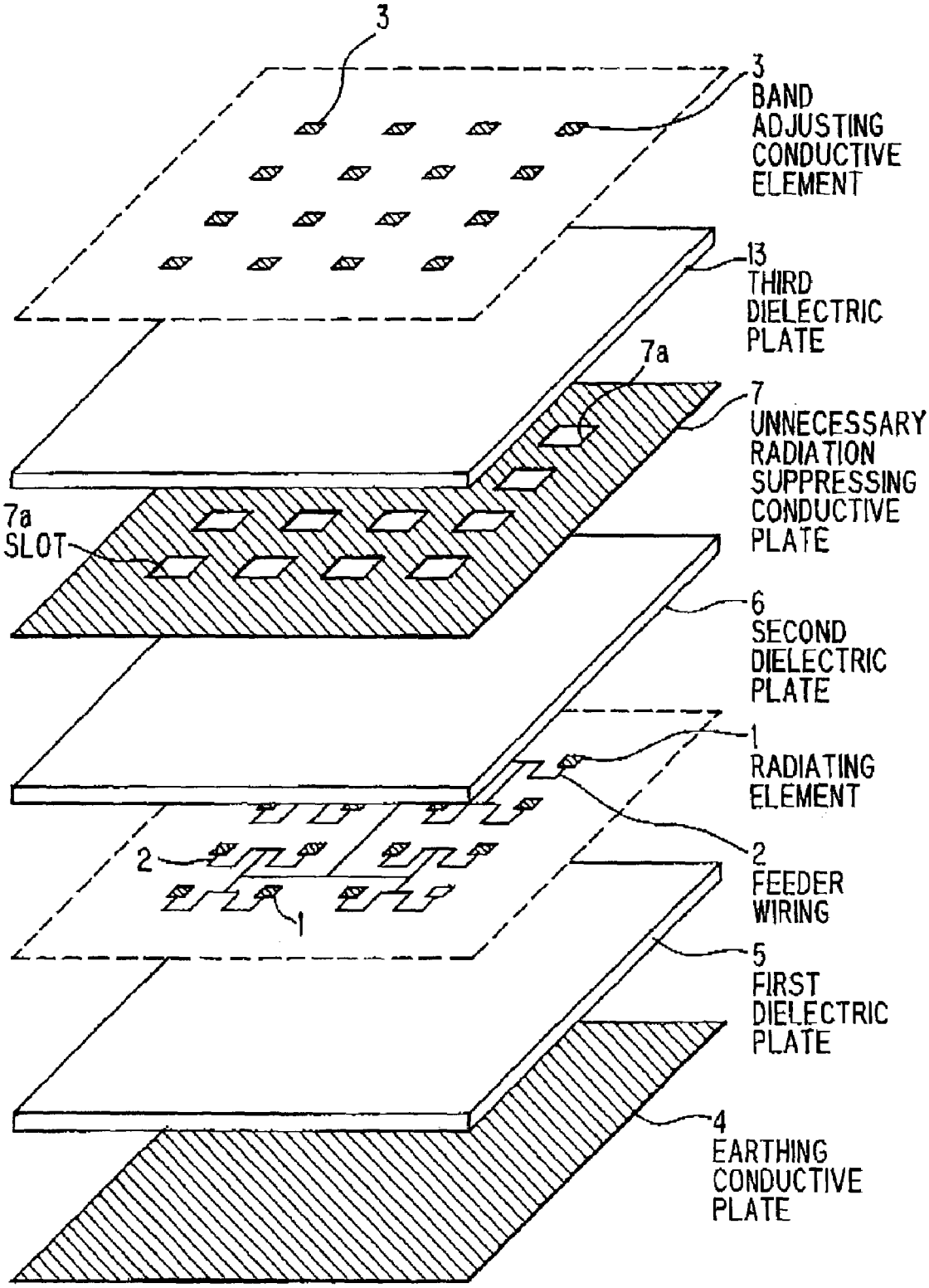
FIG. 10 is a broken perspective view showing a planar antenna in a further preferred embodiment according to the invention.

FIG. 10 is a broken perspective view showing the planar antenna in the further preferred embodiment according to the invention.

This embodiment is different from that shown in FIG. 9 in that the third dielectric plate 13 and the band adjusting conductive elements 3 are further stacked on the unnecessary radiation suppressing conductive plate 7.

The earthing conductive plate 4, first dielectric plate 5, radiating elements 1 and feeder wiring 2 are fabricated using a double-sided printed wiring board (first substrate). The second dielectric plate 6 and unnecessary radiation suppressing conductive plate 7 are fabricated using a single-sided printed wiring board (second substrate) The third dielectric plate 13 and band adjusting conductive elements 3 are fabricated using a single-sided printed wiring board (third substrate).

The first substrate is fabricated such that, of the double-sided wiring board that is made by attaching copper foils onto both surfaces of the first dielectric plate 5 of, e.g., Teflon®, one surface foil (in FIG. 10, lower surface) itself is used as the earthing conductive plate 4, the other surface foil (in FIG. 10, upper surface) is patterned by etching to form the radiating elements 1 and feeder wiring 2.

The second substrate is fabricated such that the single-sided wiring board is made by attaching a copper foil (=unnecessary radiation suppressing conductive plate 7) onto one surface of the second dielectric plate 6, then the copper foil 7 is patterned by etching to have the slots 7*a*.

The third substrate is fabricated such that the single-sided wiring board is made by attaching a copper foil onto one surface of the third dielectric plate 13, then the copper foil is patterned by etching to have the adjusting conductive elements 3.

The planar antenna is assembled by stacking the first substrate, second substrate and third substrate while sandwiching a bonding sheet (not shown) therebetween, melting the bonding sheet by heating, then jointing together the three substrates by adhesion.

The planar antenna thus composed can efficiently adapt to two kinds of frequency bands and suppress the radiation of unnecessary radio wave to adjust the directivity.

Since the first, second and third substrates are obtained by etching a printed wiring board and are jointed together by adhesion, the planar antenna thus composed has a higher productivity.

The planar antenna shown in FIG. 10 is also assembled by another way <1>described below.

A first substrate composed of the earthing conductive plate 4 and the first dielectric plate 5 is fabricated using a single-sided printed wiring board, the copper foil of which itself being used as the earthing conductive plate 4, a second substrate composed of the radiating elements 1, the feeder wiring 2 and the second dielectric plate 6 is fabricated using a single-sided printed wiring board, the copper foil of which being etched to give the radiating elements 1 and feeder wiring 2, and a third substrate composed of the unnecessary radiation suppressing conductive plate 7, the third dielectric plate 1-3 and the band adjusting conductive elements 3 is fabricated using a double-sided printed wiring board, one copper foil surface of which being etched to give the unnecessary radiation suppressing conductive plate 7 and the other copper foil surface of which being etched to give the band adjusting conductive elements 3.

Then, the planar antenna is assembled by stacking the first substrate, second substrate and third substrate while sandwiching a bonding sheet therebetween, melting the bonding sheet by heating, then jointing together the three substrates by adhesion.

The planar antenna thus composed can efficiently adapt to two kinds of frequency bands and suppress the radiation of unnecessary radio wave to adjust the directivity.

Since the first, second and third substrates are obtained by etching a printed wiring board and are jointed together by adhesion, the planar antenna thus composed has a higher productivity.

The planar antenna shown in FIG. 10 is also assembled by a further another way <2>described below.

A first substrate composed of the earthing conductive plate 4, the first dielectric plate 5, the radiating elements 1 and the feeder wiring 2 is fabricated using a double-sided printed wiring board, one copper foil surface (in FIG. 10, lower surface) of which itself being used as the earthing conductive plate 4 and the other copper foil surface (in FIG. 10, upper surface) of which being etched to give the radiating elements 1 and the feeder wiring 2, a second substrate is composed of the second dielectric plate 6 with no copper foil, and a third substrate composed of the unnecessary radiation suppressing conductive plate 7, the third dielectric plate 13 and the band adjusting conductive elements 3 is fabricated using a double-sided printed wiring board, one copper toil surface (in FIG. 10, lower surface) of which being etched to give the unnecessary radiation suppressing conductive plate 7 and the other copper foil surface (in FIG. 10, upper surface) of which being etched to give the band adjusting conductive elements 3.

Then, the planar antenna is assembled by stacking the first substrate, second substrate and third substrate while sandwiching a bonding sheet therebetween, melting the bonding sheet by heating, then jointing together the three substrates by adhesion.

The planar antenna thus composed can efficiently adapt to two kinds of frequency bands and suppress the radiation of unnecessary radio wave to adjust the directivity.

Since the first and third substrates are obtained by etching a printed wiring board and are jointed together by adhesion, the planar antenna thus composed has a higher productivity.

Figure 11:
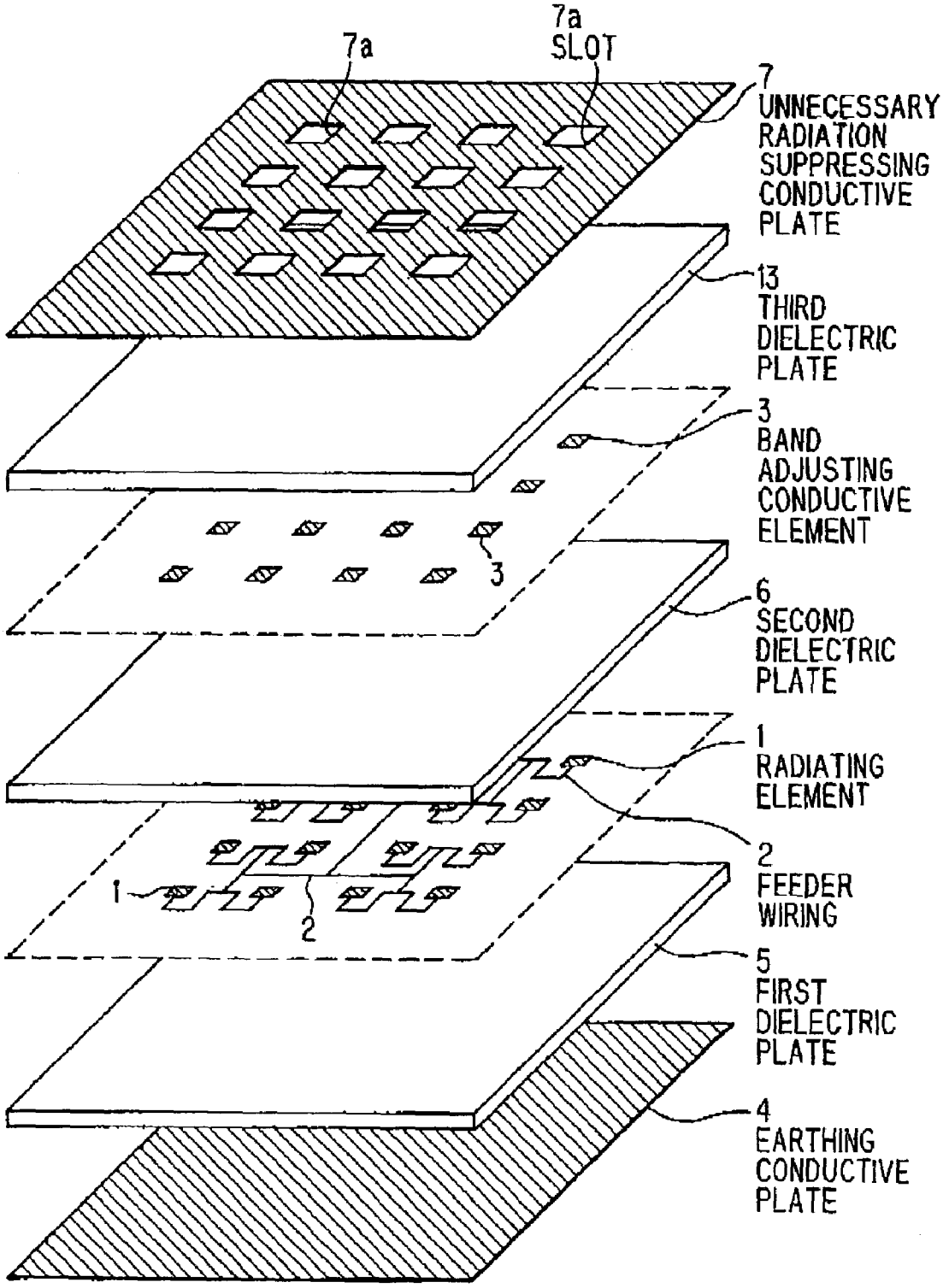
FIG. 11 is a broken perspective view showing a planar antenna in a further preferred embodiment according to the invention.

FIG. 11 is a broken perspective view showing the planar antenna in the further preferred embodiment according to the invention.

The planar antenna is composed of: an earthing conductive plate 4; a first dielectric plate 5; a plurality of radiating elements 1 that are connected in parallel by a feeder wiring 2; a second dielectric plate 6; band adjusting conductive elements 3; a third dielectric plate 13 and an unnecessary radiation suppressing conductive plate 7, the earthing conductive plate 4 to the unnecessary radiation suppressing conductive plate 7 being stacked in this order.

A first substrate composed of the earthing conductive plate 4, the first dielectric plate 5 of Teflon®, the radiating elements 1 and the feeder wiring 2 is fabricated using a double-sided printed wiring board, one copper foil surface (in FIG. 11, lower surface) of which itself being used as the earthing conductive plate 4 and the other copper foil surface (in FIG. 11, upper surface) of which being etched to give the radiating elements 1 and the feeder wiring 2.

A second substrate composed of the second dielectric plate 6 of Teflon® and the band adjusting conductive elements 3 is fabricated using a single-sided printed wiring board, one copper foil surface of which being etched to give the band adjusting conductive elements 3.

A third substrate composed of the third dielectric plate 13 of Teflon® and the unnecessary radiation suppressing conductive plate 7 is fabricated using a single-sided printed wiring board, one copper foil surface of which being etched to give the unnecessary radiation suppressing conductive plate 7 with slots 7*a*.

Then, the planar antenna is assembled by stacking the first substrate, second substrate and third substrate while sandwiching a bonding sheet therebetween, melting the bonding sheet by heating, then jointing together the three substrates by adhesion.

The planar antenna thus composed can efficiently adapt to two kinds of frequency bands and suppress the radiation of unnecessary radio wave to adjust the directivity.

Since the first, second and third substrates are obtained by etching a printed wiring board and are jointed together by adhesion, the planar antenna thus composed has a higher productivity.

The planar antenna shown in FIG. 11 is also assembled by another way <1>described below.

A first substrate composed of the earthing conductive plate 4 and the first dielectric plate 5 of Teflon® is fabricated using a single-sided printed wiring board, one copper foil surface of which itself being used as the earthing conductive plate 4, a second substrate composed of the radiating elements 1, the feeder wiring 2 and the second dielectric plate 6 of Teflon® is fabricated using a single-sided printed wiring board, one copper foil surface of which being etched to give the radiating elements 1 and the feeder wiring 2, and a third substrate composed of the band adjusting conductive elements 3, the third dielectric plate 13 of Teflon® and the unnecessary radiation suppressing conductive plate 7 is fabricated using a double-sided printed wiring board, one copper foil surface (in FIG. 11, lower surface) of which being etched to give the band adjusting conductive elements 3 and the other copper foil surface (in FIG. 11, upper surface) of which being etched to give the unnecessary radiation suppressing conductive plate 7.

Then, the planar antenna is assembled by stacking the first substrate, second substrate and third substrate while sandwiching a bonding sheet therebetween, melting the bonding sheet by heating, then jointing together the three substrates by adhesion.

The planar antenna thus composed can efficiently adapt to two kinds of frequency bands and suppress the radiation of unnecessary radio wave to adjust the directivity.

Since the first, second and third substrates are obtained by etching a printed wiring board and are jointed together by adhesion, the planar antenna thus composed has a higher productivity.

The planar antenna shown in FIG. 11 is also assembled by a further another way <2>described below.

A first substrate composed of the earthing conductive plate 4, the first dielectric plate 5 of Teflon®, the radiating elements 1 and the feeder wiring 2 is fabricated using a double-sided printed wiring board, one copper foil surface (in FIG. 11, lower surface) of which itself being used as the earthing conductive plate 4 and the other copper foil surface (in FIG. 11, upper surface) of which being etched to give the radiating elements 1 and the feeder wiring 2, a second substrate is composed of the second dielectric plate 6 of Teflon® with no copper foil, and a third substrate composed of the band adjusting conductive elements 3, the third dielectric plate 13 of Teflon® and the unnecessary radiation suppressing conductive plate 7 is fabricated using a double-sided printed wiring board, one copper foil surface (in FIG. 11, lower surface) of which being etched to give the band adjusting conductive elements 3 and the other copper foil surface (in FIG. 11, upper surface) of which being etched to give the unnecessary radiation suppressing conductive plate 7.

Then, the planar antenna is assembled by stacking the first substrate, second substrate and third substrate while sandwiching a bonding sheet therebetween, melting the bonding sheet by heating, then jointing together the three substrates by adhesion.

The planar antenna thus composed can efficiently adapt to two kinds of frequency bands and suppress the radiation of unnecessary radio wave to adjust the directivity.

Since the first and third substrates are obtained by etching a printed wiring board and are jointed together by adhesion, the planar antenna thus composed has a higher productivity.

Figure 12:
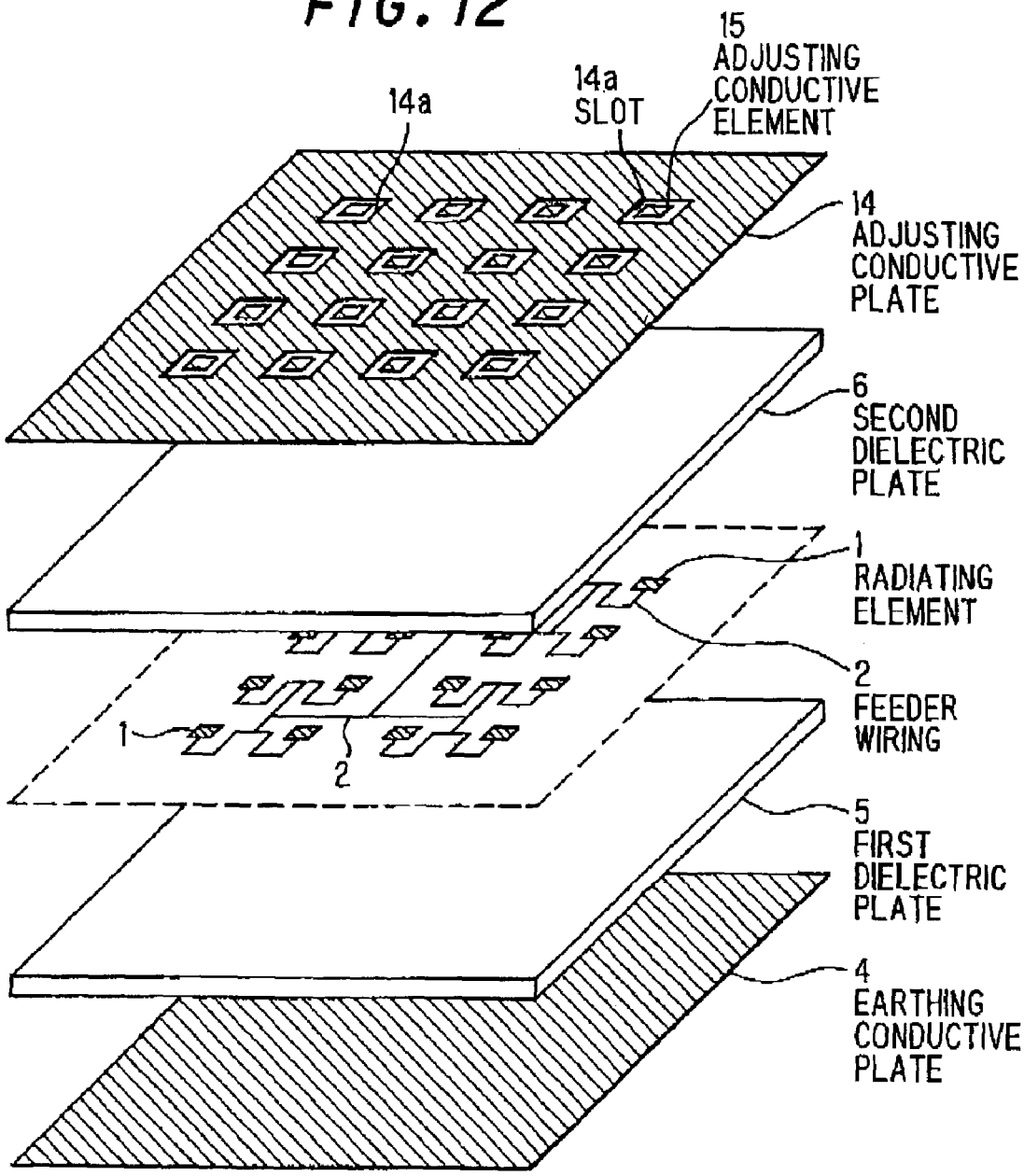
FIG. 12 is a broken perspective view showing a planar antenna in a further preferred embodiment according to the invention.

FIG. 12 is a broken perspective view showing the planar antenna in the further preferred embodiment according to the invention.

This embodiment is different from that shown in FIG. 11 in that adjusting conductive elements 15 are used instead of the band adjusting conductive elements 3 and the unnecessary radiation suppressing conductive plate 7.

As shown in FIG. 12, the planar antenna is composed of; an earthing conductive plate 4; a first dielectric plate S; a plurality of radiating elements 1 that are connected in parallel by a feeder wiring 2; a second dielectric plate 6; and an adjusting conductive plate 14 where a plurality of adjusting conductive elements 15 are formed in respective slots 14*a*, the earthing conductive plate 4 to the adjusting conductive plate 14 being stacked in this order.

A first substrate composed of the earthing conductive plate 4, the first dielectric plate 5 of Teflon®, the radiating elements 1 and the feeder wiring 2 is fabricated using a double-sided printed wiring board, one copper foil surface (in FIG. 12, lower surface) of which itself being used as the earthing conductive plate 4 and the other copper foil surface (in FIG. 12, upper surface) of which being etched to give the radiating elements 1 and the feeder wiring 2.

A second substrate composed of the second dielectric plate 6 of Teflon® and the adjusting conductive plate 14 is fabricated using a single-sided printed wiring board, one copper foil surface of which being etched to give the slots 14*a* and the adjusting conductive elements 15 in the respective slots 14*a*. The adjusting conductive elements 15 function to adjust the directivity and frequency band.

The planar antenna is assembled by stacking the first substrate and second substrate sandwiching a bonding sheet therebetween, melting the bonding sheet by heating, then jointing together the two substrates by adhesion.

The planar antenna thus composed can efficiently adapt to two kinds of frequency bands and suppress the radiation of unnecessary radio wave to adjust the directivity and frequency band.

Since the first and second substrates are obtained by etching a printed wiring board and are jointed together by adhesion, the planar antenna thus composed has a higher productivity.

The planar antenna shown in FIG. 12 is also assembled by another way <1>described below.

A first substrate composed of the earthing conductive plate 4 and the first dielectric plate 5 of Teflon® is fabricated using a single-sided printed wiring board, one copper foil surface of which itself being used as the earthing conductive plate 4, a second substrate composed of the radiating elements 1, the feeder wiring 2, the second dielectric plate 6 of Teflon® and the adjusting conductive plate 14 is fabricated using a double-sided printed wiring board, one copper foil surface (in FIG. 12, lower surface) of which being etched to give the radiating elements 1 and the feeder wiring 2 and the other copper foil surface (in FIG. 12, upper surface) of which being etched to give the slots 14*a* and the adjusting conductive elements 15.

The planar antenna is assembled by stacking the first substrate and second substrate sandwiching a bonding sheet therebetween, melting the bonding sheet by heating, then jointing together the two substrates by adhesion, The planar antenna thus composed can efficiently adapt to two kinds of frequency bands and suppress the radiation of unnecessary radio wave to adjust the directivity and frequency band.

Since the first and second substrates are obtained by etching a printed wiring board and are jointed together by adhesion, the planar antenna thus composed has a higher productivity.

Figure 13:
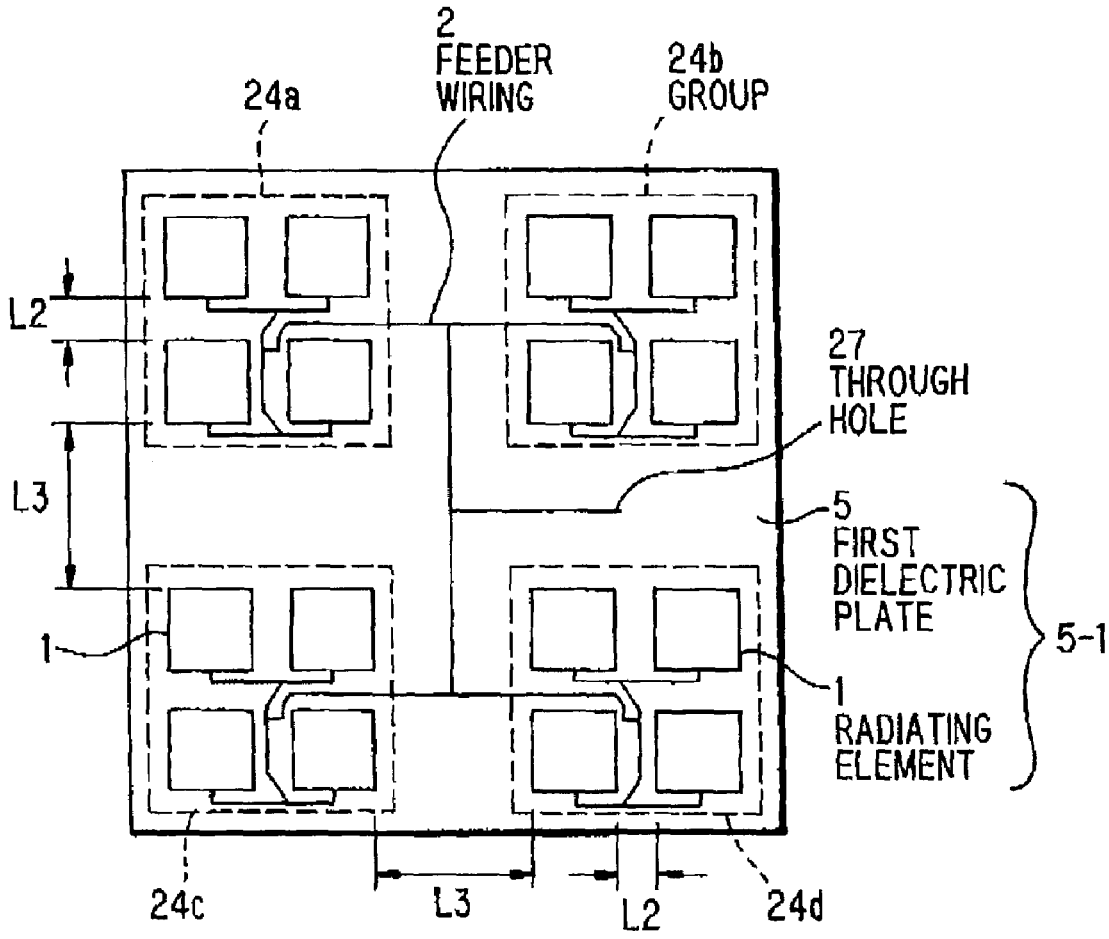
FIG. 13 is a plan view showing a radiating element plate 5-1 available for a planar antenna in a preferred embodiment according to the invention.

FIG. 13 is a plan view showing a radiating element plate 5-1 available for the planar antenna in the preferred embodiment according to the invention.

The radiating element plate 5-1 is formed such that a plurality of radiating elements 1, whose number is sixteen in FIG. 13 but not limited by this number, are provided on the first dielectric plate 5 and divided into groups 24*a* to 24*d*, whose number is four in FIG. 13 but not limited by this number, and that the interval L3 between the respective groups 24*a* to 24*d* is different from the interval L2 between the respective radiating elements 1, where L2<L3 is preferable.

When the radiating elements 1 are thus arranged divided into the groups 24*a* to 24*d*, the degree of interference between the respective groups 24*a* to 24*d* can be reduced and the degree of interference between the feeder wiring 2 and the respective radiating elements 1 can be reduced. As a result, the directivity of the entire planar antenna can be enhanced.

Figure 14:
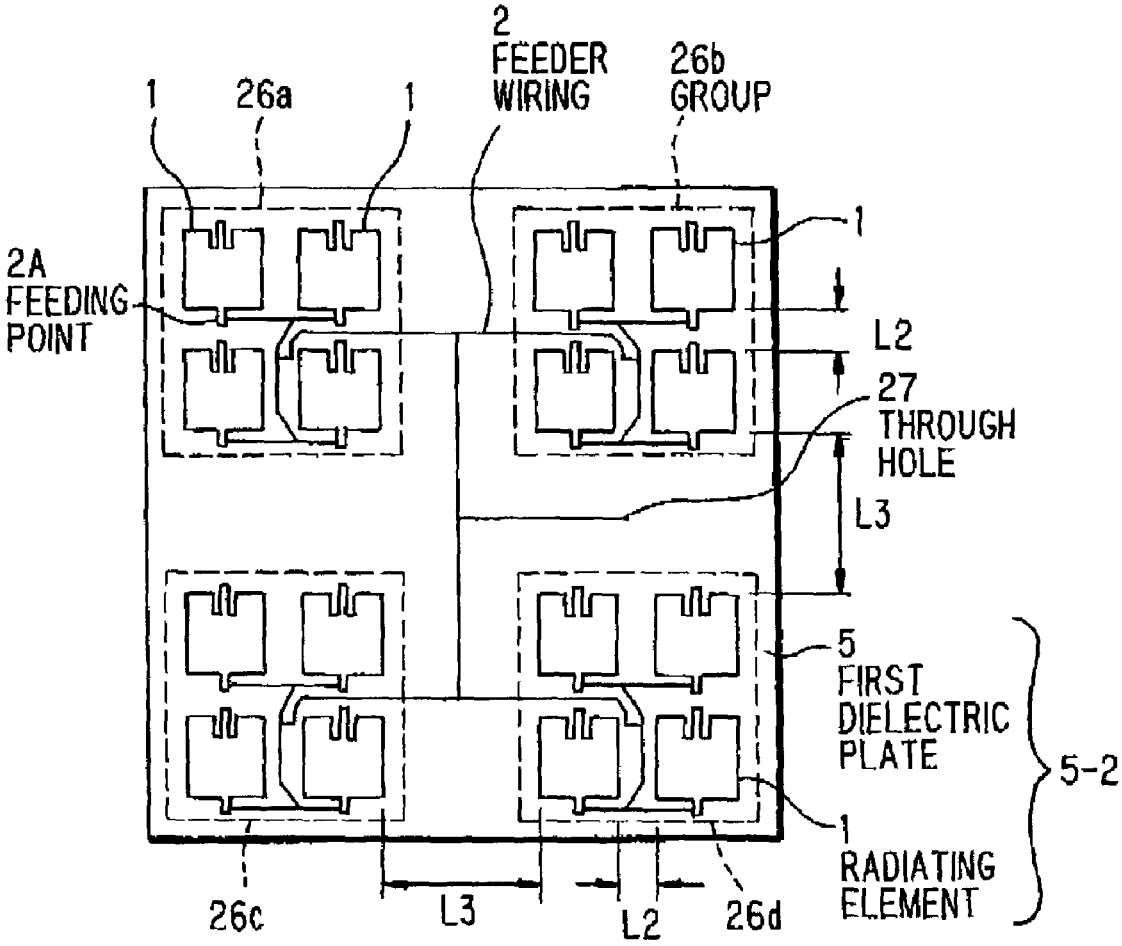
FIG. 14 is a plan view showing another radiating element plate 5-2 available for a planar antenna in a preferred embodiment according to the invention.

FIG. 14 is a plan view showing another radiating element plate 5-2 available for the planar antenna in the preferred embodiment according to the invention.

The details of a radiating element 1 composing the radiating element plate 5-2 in FIG. 14 are described earlier with reference to FIG. 3.

As shown in FIG. 14, the radiating element plate 5-2 is formed such that a plurality of radiating elements 1, whose number is sixteen in FIG. 14 but not limited by this number, are provided on the first dielectric plate 5 of, e.g., Teflon®, ceramic, glass epoxy etc. and divided into groups 26*a* to 26*d*, whose number is four in FIG. 14 but not limited by this number, and that the interval L3 between the respective groups 26*a* to 26*d* is different from the interval L2 between the respective radiating elements 1, where L2<L3 is preferable.

As shown in FIG. 14, the feeding points 2A of the respective radiating elements 1 are connected at the respective groups 26*a* to 26*d*, where the connecting points are connected in parallel by the feeder wiring 2. A through hole 27 to which the end of the feeder wiring 2 is connected is provided for connecting the feeder wiring 2 with a coaxial cable (not shown, refer to FIG. 2)

Figure 15:
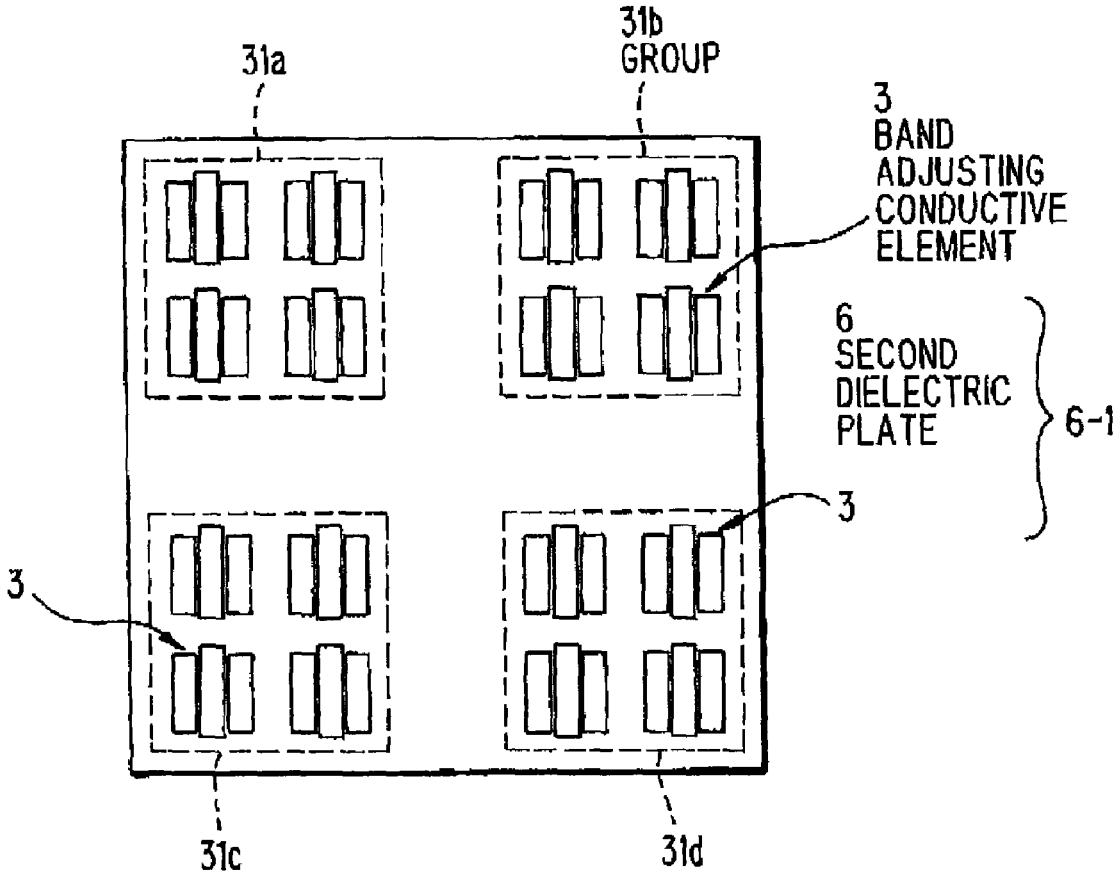
FIG. 15 is a plan view showing a band adjusting conductive element plate 6-1 available for a planar antenna in a preferred embodiment according to the invention.

FIG. 15 is a plan view showing a band adjusting conductive element plate 6-1 available for the planar antenna in the preferred embodiment according to the invention.

The details of a band adjusting conductive element 3 composing the band adjusting conductive element plate 6-1 in FIG. 15 are described earlier with reference to FIG. 4.

As shown in FIG. 15, the band adjusting conductive element plate 6-1 is formed such that a plurality of band adjusting conductive elements 3, whose number is sixteen in FIG. 15 but not limited by this number, are provided on the second dielectric plate 6 of, e.g., Teflon®, ceramic, glass epoxy etc. The band adjusting conductive element plate 6-1 is stacked in parallel on the radiating element plate 5-2 in FIG. 14 so that the respective band adjusting conductive elements 3 can be located corresponding to the respective radiating elements 1. Therefore, the band adjusting conductive elements 3 are also divided into groups 31*a* to 31*d*, whose number is four in FIG. 15 but not limited by this number and can be the same-number as the groups of radiating elements 1.

Figure 16:
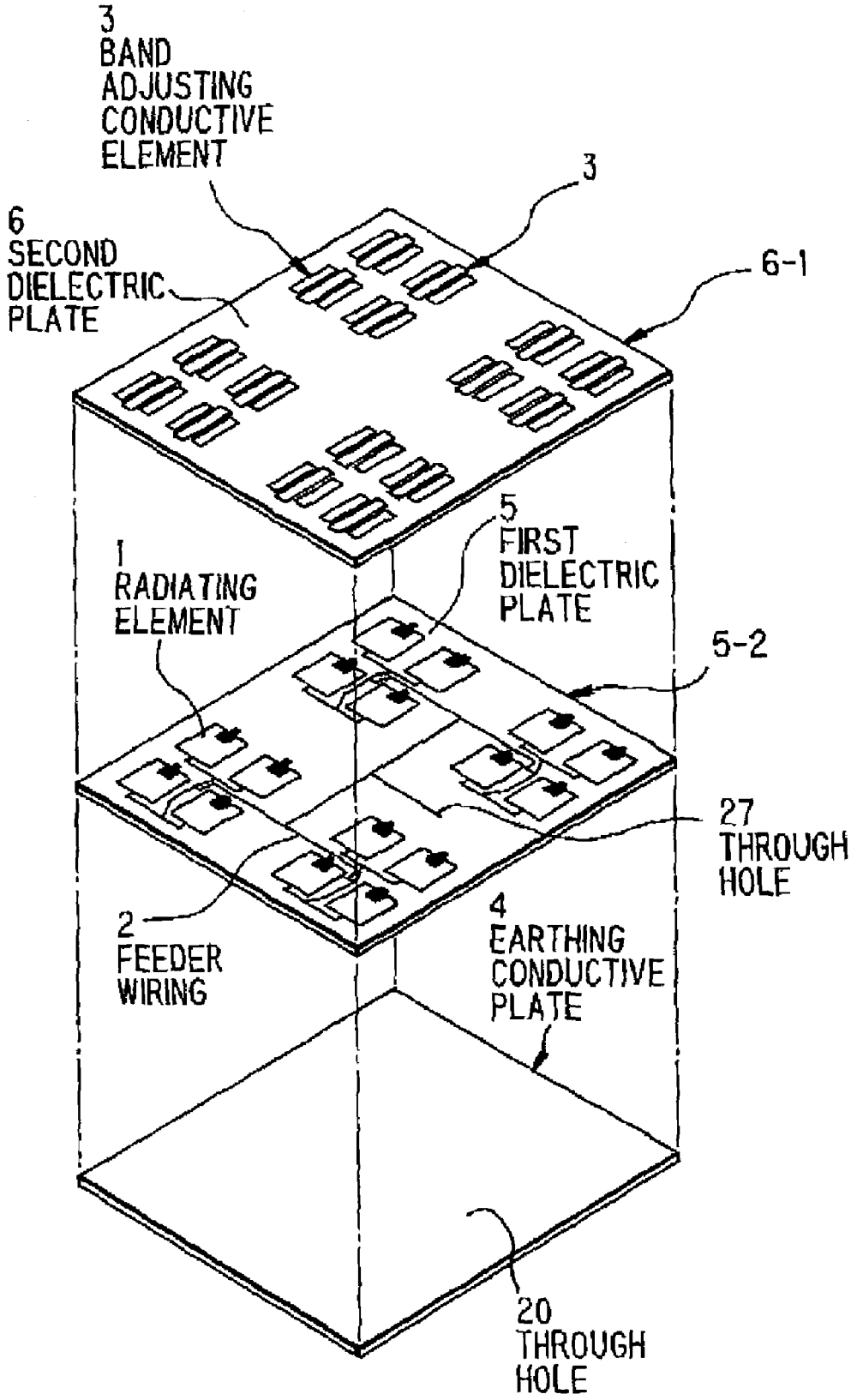
FIG. 16 is a broken perspective view showing a planar antenna in a further preferred embodiment according to the invention.

FIG. 16 is a broken perspective view showing a planar antenna in the further preferred embodiment according to the invention.

As shown in FIG. 16, the planar antenna is composed of an earthing conductive plate 4 (e.g., gold or silver-plated copper plate); a bonding sheet (not shown); the radiating element plate 5-2; a bonding sheet (not shown); the band adjusting conductive element plate 6-1. The components above are stacked in this order and then the bonding sheet is melt by heating to joint together them by adhesion.

A through hole 20 to fix the coaxial cable (not shown) is formed in the earthing conductive plate 4. The net wires of coaxial cable are connected to the through hole 20, and the center conductor of the coaxial cable is connected to the through hole 27 of the radiating element plate 5-2.

As described above, in the planar antenna shown in FIG. 16, the radiating elements 1 are divided into the groups 26*a* to 26*d* and the interval L2 between the radiating elements 1 is different from the interval L3 between the groups 26*a* to 26*d*. Therefore, the degree of interference between the respective groups 26*a* to 26*d* can be reduced and the degree of interference between the feeder wiring 2 and the respective radiating elements 1 can be reduced. As a result, the directivity of the entire planar antenna can be enhanced.

Furthermore, since the radiating element 1 is formed as shown in FIG. 3, even one radiating element 1, i.e., one planar antenna can efficiently adapt to two kinds of frequency bands. Also, due to the band adjusting conductive elements 3 located in parallel corresponding to the radiating elements 1, the planar antenna can have a wide frequency band.

Figure 17A:
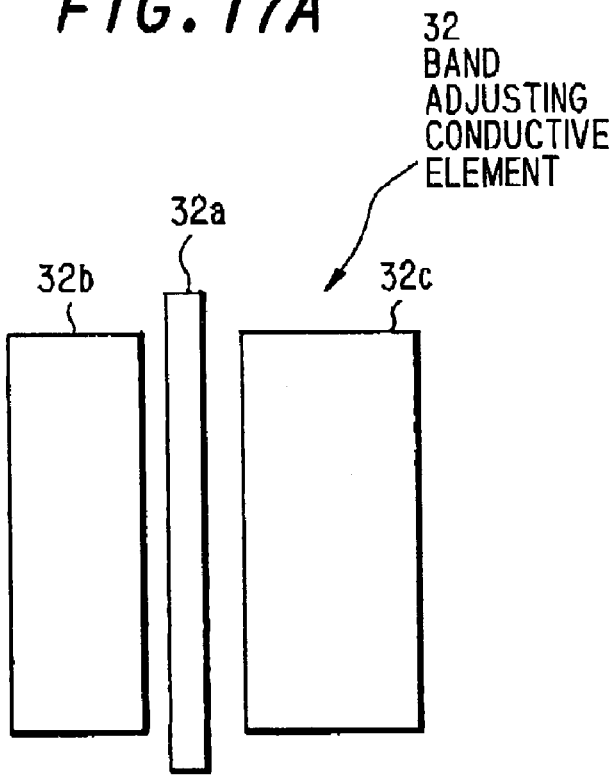
FIG. 17A is a plan view showing a band adjusting conductive element 32 in a preferred embodiment according to the invention.
Figure 17B:
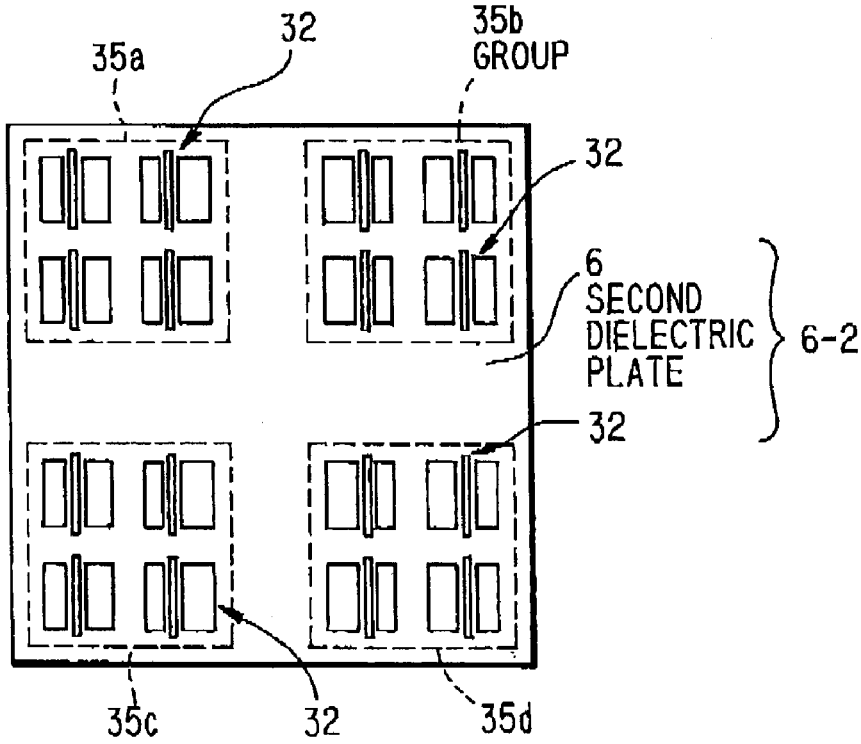
FIG. 17B is a plan view showing a band adjusting conductive element plate 6-2 using the band adjusting conductive elements 32 in FIG. 17A.

FIG. 17A is a plan view showing a band adjusting conductive element 32 in another preferred embodiment according to the invention. FIG. 17B is a plan view showing a band adjusting conductive element plate 6-2 using the band adjusting conductive elements 32 in FIG. 17A.

This embodiment is different from that shown in FIG. 15 (or FIG. 4) in that, as shown in FIG. 17A, conductive plates 32*b*, 32*c* with a length corresponding to the half wavelength of transmission radio frequency signal f2 (frequency f2) are separately and asymmetrically (not at equal interval) located on both sides of central conductive part 32*a* with a length corresponding to the half wavelength of transmission radio frequency signal f1 (frequency fl), whose frequency is different from that of signal f2.

As shown in FIG. 17B, the band adjusting conductive element plate 6-2 is formed such that a plurality of band adjusting conductive elements 32, whose number is sixteen in FIG. 17B but not limited by this number and can be the same number as the radiating elements 1, are provided on the second dielectric plate 6 of, e.g., Teflon®, ceramic, glass epoxy etc. The band adjusting conductive element plate 6-2 is stacked in parallel on the radiating element plate 5-2 in FIG. 14 so that the respective band adjusting conductive elements 32 can be located corresponding to the respective radiating elements 1. Therefore, the band adjusting conductive elements 3 are also divided into groups 35*a* to 35*d*, whose number is four in FIG. 17B but not limited by this number and can be the same number as the groups of radiating elements 1.

When the band adjusting conductive element plate 6-2 is thus composed, the directivity of main beam radiated from the respective radiating elements 32 can be biased toward the center of the entire planar antenna, thereby enhancing the directivity of the entire planar antenna.

Figure 18:
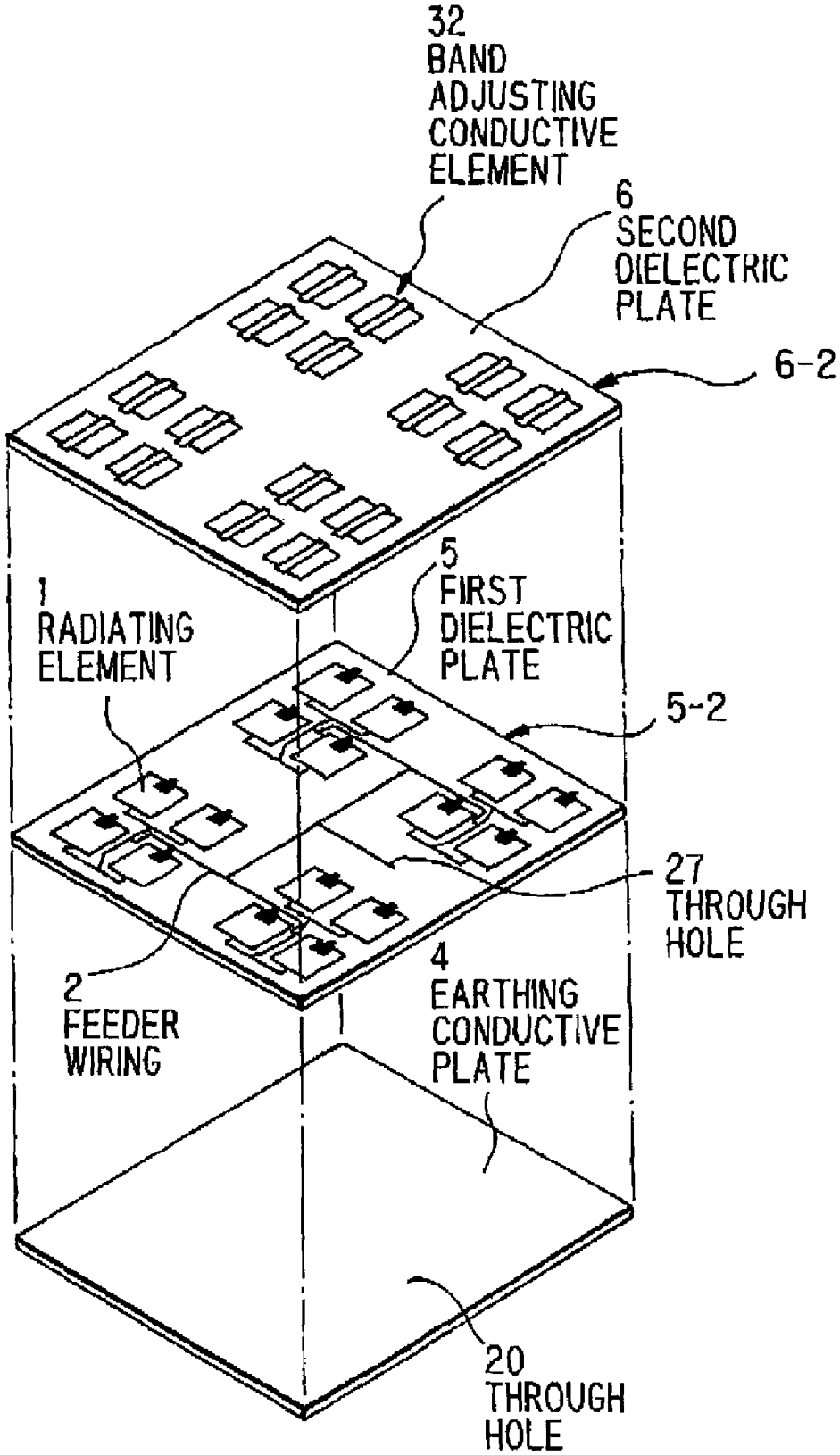
FIG. 18 is a broken perspective view showing a planar antenna in a further preferred embodiment according to the invention.

FIG. 18 is a broken perspective view showing a planar antenna in the further preferred embodiment according to the invention.

This embodiment is different from that shown in FIG. 16 in that the band adjusting conductive element plate 6-2 in FIG. 17B is used.

Since the planar antenna, as shown in FIG. 18, uses the band adjusting conductive element plate 6-2 in FIG. 17B, the central conductive plate 32*a* functions to intensively influence the signal of lower frequency band f1 to lower the sensitivity thereof, thereby enlarging the band width of the frequency band f1. Also, the conductive plates 32*b*, 32*c* function to intensively influence the signal of higher frequency band f2 to lower the sensitivity thereof, thereby enlarging the band width of the frequency band f2.

Accordingly, the planar antenna thus composed can efficiently adapt to two kinds of frequency band, and suppress the radiation of unnecessary radio wave to enlarge the radiation frequency band.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A planar antenna comprising a radiating element that radiates electric wave, an earthing conductive plate that reflects the electric wave radiated from said radiating element, said radiating element is formed on one surface of a first dielectric plate, the other surface of said first dielectric plate facing said earthing conductive plate; and having a space between said earthing conductive plate and said radiating element;

said radiating element is composed of a central conductive part with a length corresponding to the half wavelength of one of a plurality of transmission radio frequency signals with different frequencies, and conductive parts with a length corresponding to the half wavelength of the other of said plurality of transmission radio frequency signals, said central conductive part and said conductive parts being formed into one body such that said conductive parts are located self-symmetrical to said central conductive part.

2. A planar antenna according to claim 1, further comprising:

a band adjusting conductive element that is composed of separated conductive plates each of which has a length corresponding to each of the half wavelength of said plurality of transmission radio frequency signals, said band adjusting conductive element being placed facing said radiating element above one surface of said first dielectric plate.

3. A planar antenna according to claim 1, further comprising:

an unnecessary radiation suppressing conductive plate that suppresses unnecessary electric wave radiated from said radiating element, said unnecessary radiation suppressing conductive plate being placed above one surface of said first dielectric plate.

4. A planar antenna according to claim 1, further comprising:

a band adjusting conductive element that is composed of separated conductive plates each of which has a length corresponding to the respective half wavelength of said plurality of transmission radio frequency signals; and an unnecessary radiation suppressing conductive plate that suppresses unnecessary electric wave radiated from said radiating element;

wherein said band adjusting conductive element and said unnecessary radiation suppressing conductive plate are formed one a second dielectric plate, said second dielectric plate being placed in parallel above one surface of said dielectric plate.

5. A planar antenna according to claim 4, wherein:

said band adjusting conductive element is placed in a slot that is formed in said unnecessary radiation suppressing conductive plate.

6. A planar antenna according to claim 5, wherein:

said planar antenna has a plurality of radiating elements, band adjusting conductive elements and slots, respectively.

7. A planar antenna comprising a radiating element that radiates electric wave, said radiating element being of a conductive plate, wherein:

said radiating element is composed of a strip-shaped central conductive part with a length corresponding to the half wavelength of a first transmission radio frequency signal, and strip-shaped conductive parts with a length corresponding to the half wavelength of a second transmission radio frequency signal that has a frequency different from that of said first transmission radio frequency signal, said central conductive part and said conductive parts being formed into one body such that said conductive parts are located self-symmetrical to said central conductive part.

8. A planar antenna according to claim 7, wherein:

said radiating element has a cutting region between said central conductive part and said respective conductive parts.

9. A planar antenna according to claim 7, further comprising:

a band adjusting conductive element that is composed of a plurality of separated conductive plates each of which has a length corresponding to each of the half wavelength of said first and second transmission radio frequency signals, said plurality of separated conductive plates being placed facing each of said radiating element.

10. A planar antenna according to claim 7, further comprising:

an unnecessary radiation suppressing conductive plate that suppresses unnecessary electric wave radiated from said radiating element, said unnecessary radiation suppressing conductive plate having a slot and said slot being placed facing said radiating element.

11. A planar antenna according to claim 7, further comprising:

an adjusting conductive plate that is composed of: a band adjusting conductive element that is composed of a plurality of separated conductive plates each of which has a length corresponding to each of the half wavelength of said first and second transmission radio frequency signals; and an unnecessary radiation suppressing conductive plate that suppresses unnecessary electric wave radiated from said radiating element, said unnecessary radiation suppressing conductive plate having a slot, said band adjusting conductive element being placed in the slot of said unnecessary radiation suppressing conductive plate, and said adjusting conductive plate being placed facing said radiating element.

12. A planar antenna according to claim 7, wherein said planar antenna has a plurality of said radiating elements that are arrayed like a matrix on one plane, and said planar antenna further comprising: a plurality of band adjusting conductive elements that are placed facing each of said plurality of radiating elements on another plane; and an unnecessary radiation suppressing conductive plate that suppresses unnecessary electric wave radiated from said radiating element, said unnecessary radiation suppressing conductive plate having a plurality of slots each of which is placed facing each of said plurality of radiating elements.

13. A planar antenna comprising:

a plurality of radiating elements that are arrayed like a matrix on one surface of a dielectric plate, said plurality of radiating elements are divided into a plurality of groups, and the interval between said respective groups is different from the interval between said respective radiating elements, and said radiating elements each are composed of a central conductive part with a length corresponding to the half wavelength of a first transmission radio frequency signal, and conductive parts with a length corresponding to the half wavelength of a second transmission radio frequency signal that has a frequency different from that of said first transmission radio frequency signal, and said central conductive part and said conductive parts being formed into one body such that said conductive parts are located self-symmetrical to said central conductive part.

14. A planar antenna comprising:

a plurality of radiating elements that are arrayed like a matrix on one surface of a dielectric plate, said plurality of radiating elements are divided into a plurality of groups, and the interval between said respective groups is different from the interval between said respective radiating elements, and a plurality of band adjusting conductive elements that are placed parallel to said dielectric plate to correspond to said respective radiating elements.

15. A planar antenna according to claim 14, wherein:

said band adjusting conductive elements each are composed of a central conductive plate with a length corresponding to the half wavelength of a first transmission radio frequency signal, and other conductive plates each of which has a length corresponding to the half wavelength of a second transmission radio frequency signal whose frequency is different from that of said first transmission radio frequency signal, said other conductive plates being placed inter-symmetrical to said central conductive plate.

16. A planar antenna according to claim 14, wherein:

said band adjusting conductive elements each are composed of a central conductive plate with a length corresponding to the half wavelength of a first transmission radio frequency signal, and other conductive plates each of which has a length corresponding to the half wavelength of a second transmission radio frequency signal whose frequency is different from that of said first transmission radio frequency signal, said other conductive plates being placed asymmetrical to said central conductive plate.

* * * * *